US007731583B2

(12) United States Patent
Seelig et al.

(10) Patent No.: US 7,731,583 B2
(45) **Date of Patent: *Jun. 8, 2010**

(54) GAMING DISPLAY WITH MOVEABLE INDICATOR AND METHODS OF USE

(75) Inventors: Jerald C. Seelig, Absecon, NJ (US); Lawrence M. Henshaw, Hammonton, NJ (US)

(73) Assignee: Atlantic City Coin & Slot Service Company, Inc., Pleasantville, NJ (US)

( * ) Notice: Subject to any disclaimer, the term of this patent is extended or adjusted under 35 U.S.C. 154(b) by 1243 days.

This patent is subject to a terminal disclaimer.

(21) Appl. No.: 10/806,636

(22) Filed: Mar. 23, 2004

(65) Prior Publication Data

US 2004/0180716 A1 Sep. 16, 2004

Related U.S. Application Data

(60) Provisional application No. 60/503,306, filed on Sep. 15, 2003, provisional application No. 60/458,764, filed on Mar. 28, 2003.

(51) Int. Cl.
*A63F 9/24* (2006.01)

(52) U.S. Cl. ..... 463/20; 463/16; 463/30; 463/31

(58) Field of Classification Search ..... None
See application file for complete search history.

(56) References Cited

U.S. PATENT DOCUMENTS 3,645,531 A * 2/1972 Wright ..... 463/17
5,673,504 A * 10/1997 Brown ..... 40/518
6,464,581 B1 * 10/2002 Yoseloff et al. ..... 463/20
6,712,694 B1 3/2004 Nordman
6,805,632 B2 10/2004 Suda
7,278,638 B2 * 10/2007 Nordman ..... 273/292
2004/0171423 A1 * 9/2004 Silva et al. ..... 463/31
2005/0020348 A1 * 1/2005 Thomas et al. ..... 463/20

* cited by examiner

*Primary Examiner*—Corbett B Coburn
(74) *Attorney, Agent, or Firm*—Ian F. Burns & Associates, P.C.

(57) ABSTRACT

The present invention comprises a gaming apparatus that includes a display device comprising a display surface. The display surface comprises a plurality of indicia. A display device actuator is in communication with the display surface and is configured to move the display surface on a first predetermined path. A moveable indicator is included that is configured to indicate at least one indicia appearing on the display surface. A moveable indicator actuator is in communication with the moveable indicator and is configured to move the moveable indicator along a second predetermined path. A controller is in communication with at least one of the display device actuator and the moveable indicator actuator. The controller is configured to position at least one of the display device and the movable indicator so that the movable indicator indicates an indicia appearing on the display surface that conveys a game outcome.

27 Claims, 15 Drawing Sheets

GAMING DISPLAY WITH MOVEABLE INDICATOR AND METHODS OF USE

CROSS REFERENCES TO RELATED PATENT APPLICATIONS

This application claims priority to U.S. provisional patent application having Ser. No. 60/503,306, filed Sep. 15, 2003, entitled "Gaming Display With Movable Indicator and Methods of Use," and claims priority to U.S. provisional patent application having Ser. No. 60/458,764, filed Mar. 28, 2003, entitled, "Gaming Display With Movable Indicator and Methods of Use," the contents of which are herein incorporated by reference.

FIELD OF THE INVENTION

The present invention relates to gaming devices and, more particularly, to a gaming device having at least one moveable indicator that indicates a prize to a player.

BACKGROUND

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number (hereinafter, both types are referred to as a "random number").

The random number can be used to determine a game outcome. For example, the random number may then be compared to a predefined table to determine a corresponding outcome of the event. If the random number falls within a certain range of numbers on the table, the player may win the corresponding predefined prize. The table may also contain display information that allows the gaming device to generate a display that corresponds to the outcome of the game. The gaming device may present the outcome of the game on a large variety of display devices, such as mechanical spinning reels or video screens.

Some gaming devices award bonus prizes in addition to prizes that are awarded in a primary game. Of course, the prize in the primary game may simply be the opportunity to play the bonus game. A bonus prize is generally defined as a prize in addition to the prize obtained from the primary game and that is awarded to the player when a predefined event occurs. An example of a bonus game can be found in U.S. Pat. No. 5,848,932 to Adams. Adams discloses a primary game having three spinning game reels and a bonus game having a bonus display with one spinning wheel. The spinning wheel is divided into multiple sections, and each section has a symbol representing a prize. When predetermined indicia are displayed on the spinning game reels of the primary game, the wheel of the bonus display spins and stops. The bonus prize is displayed as the symbol on the wheel being pointed to by a pointer. The bonus prize is awarded in addition to any prizes awarded in the primary game. Another bonus game is disclosed in Baerlocher et al. (U.S. Pat. No. 6,336,863). Baerlocher et al. discloses a slot machine with a bonus award display. The bonus award display has a bonus wheel and a mechanical, movable pointer.

One of the problems associated with the devices disclosed in these references is that the outcome of the bonus game is communicated to the player almost immediately. When a bonus game is triggered, a bonus award is selected, displayed, and awarded to the player. The player can see what the outcome of the game is immediately after the pointers have stopped moving. What has long been needed is a device that utilizes intermediate steps between the occurrence of the bonus event and the awarding of the bonus prize to add an additional element of anticipation and excitement for the players. It is further desired that the intermediate steps involve an eye-catching display. Another problem associated with Adams and Baerlocher et al. is that they utilize a plain combination of wheel and pointer. The applicants have discovered more things that can be done to display devices to make them more attractive and interesting to play.

Generally, bonus prizes are awarded in order to increase the excitement and enjoyment experienced by players, which attracts more players to the game and encourages players to play longer. When this occurs, the gaming devices tend to be more commercially successful relative to other gaming devices. A shortcoming of present bonus games is that they do not sufficiently allow players to interact with the gaming device, including during bonus games.

Other attempts have been made to provide player interaction. U.S. Pat. No. 5,788,573 to Baerlocher et al. (hereinafter, "Baerlocher") purports to suggest a gaming device with an electronic "wheel of fortune game." Several flippers appear to indicate positions on the wheel. Baerlocher appears to suggest that the player may be allowed to choose which flipper is used to select an indicia on the wheel. However, the player does not appear to have any control over the position of the flipper and the flippers do not appear to be capable of moving to different positions.

U.S. Pat. No. 6,309,300 to Glavich (hereinafter, "Glavich") and U.S. Pat. No. 6,439,995 to Hughs-Baird et al. (hereinafter, "Hughs-Baird") purport to suggest a gaming system having a bonus feature where a player may be allowed to select a number of selectable items, which may be prize representations, on a video display. Glavich and Hughs-Baird do not appear to suggest using prize indicators, moveable prize indicators, or allowing a player to position a prize indicator.

SUMMARY

Advantages

The various embodiments of the present invention may, but do not necessarily, achieve one or more of the following advantages:

provide a highly attractive and entertaining device for conducting games;

provide a highly attractive and entertaining device for displaying prizes;

the ability to attract more patrons to play a game;

the ability to encourage players to play longer on a gaming apparatus;

provide at least one attractive prize indicator;

provide a unique combination of reel-type display and moveable indicator;

provide a display for displaying indicia on a first axis and a moveable indicator configured to indicate an indicia from a second axis orthogonal to the first axis;

allow players to control the movement of a prize indicator;

provide a moving display surface;

provide a moving display with a relatively long path length;

provide a display that allows for a relatively larger number of indicia to be displayed;

provide a display that allows for relatively larger indicia to be displayed;

creates additional suspense for players by increasing the length of time between the start of a game and the display of the game outcome;

allow players to control the movement of a moving display surface;

provide the illusion that the player can influence the outcome of a game;

provide a game that allows for more player interaction;

utilize intermediate steps between the occurrence of the bonus event and the awarding of the bonus prize; and provide an additional element of anticipation and excitement for players.

These and other advantages may be realized by reference to the remaining portions of the specification, claims, and abstract.

BRIEF DESCRIPTION OF CERTAIN ASPECTS OF THE INVENTION

In one embodiment, the present invention comprises a gaming apparatus that includes a display device comprising a display surface. The display surface comprises a plurality of indicia. A display device actuator may be in communication with the display surface and may be configured to move the display surface on a first predetermined path. A moveable indicator may be included that may be configured to indicate at least one indicia appearing on the display surface. A moveable indicator actuator may be in communication with the moveable indicator and may be configured to move the moveable indicator along a second predetermined path. A controller may be in communication with at least one of the display device actuator and the moveable indicator actuator. The controller may be configured to position at least one of the display device actuators and the movable indicator so that the movable indicator indicates an indicia appearing on the display surface that conveys a game outcome.

In at least one alternative embodiment, the present invention is directed to a gaming method. A gaming device may be provided. The gaming device may comprise a moveable indicator and a moveable display surface. The moveable display surface may comprise a plurality of indicia. A player may be allowed to place a wager.

The display surface may be moved along a first path. The moveable indicator may be moved along a second path. A game outcome is determined that may correspond to, and be indicated by, at least one indicia appearing on the moveable display surface. The moveable indicator may be stopped. The display surface may be stopped. In at least one embodiment, when the display surface and the moveable indicator are stopped, the moveable indicator indicates an indicia on the moveable display surface that corresponds to the game outcome.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Certain embodiments of the invention are shown in the accompanying drawings wherein.

DESCRIPTION OF AT LEAST ONE EMBODIMENT OF THE PRESENT INVENTION

In the following detailed description of at least one embodiment of the present invention, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1A:
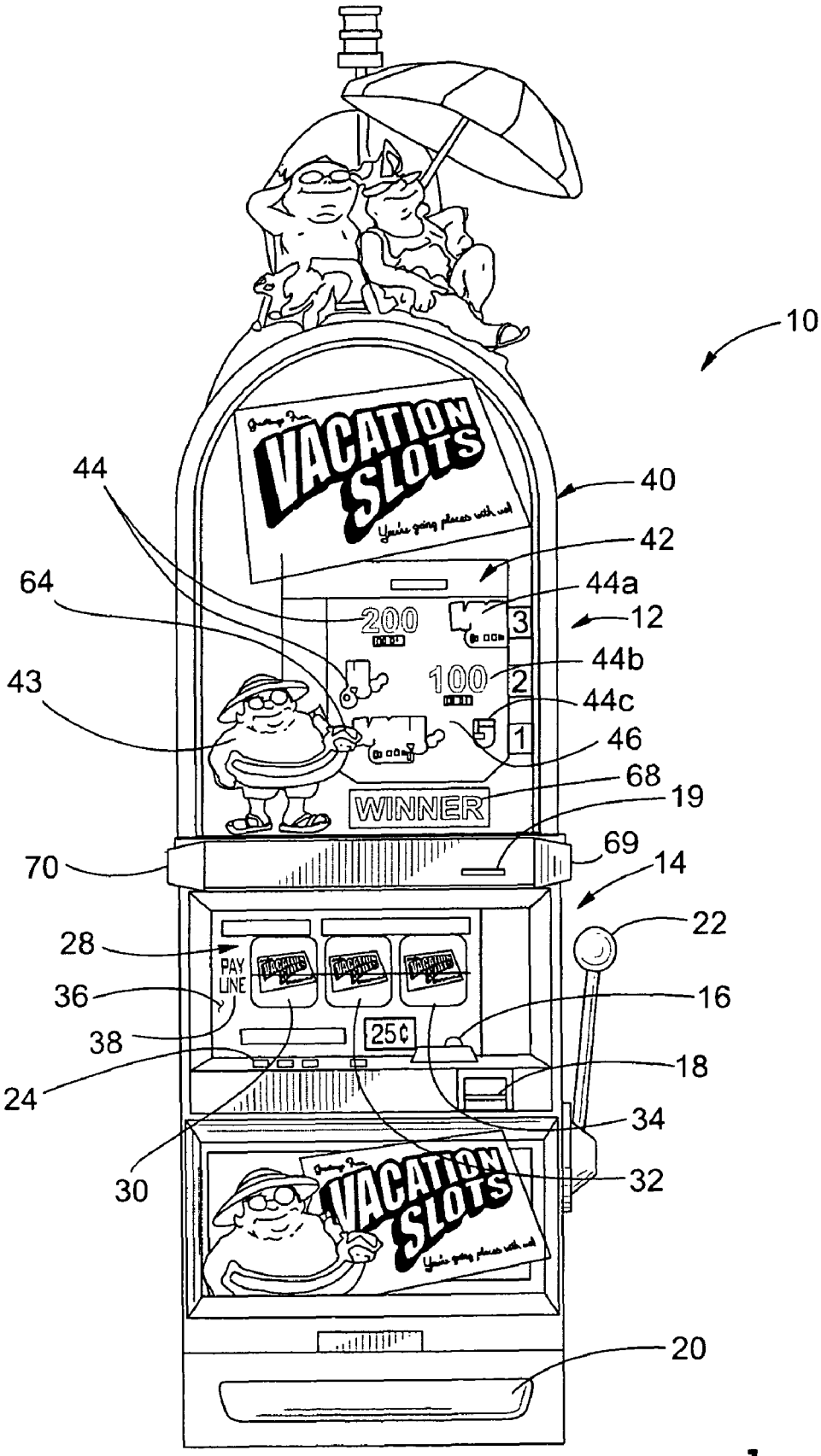
FIG. 1*a* is substantially a front elevation view of an embodiment of the gaming apparatus of the present invention.

As seen in FIG. 1*a*, the present invention comprises a gaming apparatus, generally indicated by reference number 10. In at least one embodiment, gaming apparatus 10 comprises a second display 12 and a primary gaming device 14. Gaming device 14 may be any of a large number of devices that are adapted to allow players to play a game, such as gaming devices typically found in arcade and casino environments, including arcade games, video games, gambling machines, video poker machines, slot machines, etc. In at least one embodiment, gaming device 14 is further adapted to allow a player to place a wager and play a game, such as a slot machine.

Gaming device 14 may include a value acceptor for accepting value (including currency and/or currency equivalents), such as a coin slot 16, card reader 18, or a voucher reader 19. In addition, a payout mechanism (not shown) and a coin receptacle 20 may be provided for awarding prizes or for dispensing value to players cashing out and retiring from a game. A printer (not shown) may also be provided for printing out cashless vouchers (not shown). A handle 22 and a button 24 may be provided for activating gaming device 14 to begin a game. A pay table (not shown) may further be provided to allow a player to see what symbol or combination of symbols provide a winning event. In at least one preferred embodiment, gaming device 14 may be a S2000 or S Plus model gaming device manufactured by International Game Technology in Reno, Nev.

Gaming device 14 may further include a gaming outcome display 28 that may be positioned in front of the gaming device 14 so that a player (not shown) playing gaming device 14 can see gaming outcome display 28. Gaming outcome display 28 may utilize physical game reels 30, 32, and 34. Game reels 30, 32, and 34 may be attached to a drive mechanism (not shown) of gaming device 14 to rotate the reels in a manner well known in the art. Each game reel 30, 32, and 34 may have a plurality of symbols positioned on the circumference of each game reel 30, 32, and 34. Game reels 30, 32, and 34 may be positioned side-by-side with coincident axes of rotation and a portion of their individual circumferences may face outward from gaming device 14.

A panel 36 may cover game reels 30, 32, and 34 such that only a portion of their individual circumferences are shown to the player. At least one symbol from any of game reels 30, 32, and 34 may be used to display a game outcome. At least one pay line 38 may be provided for the player to use in determining a game outcome based on the symbol or a combination of symbols positioned thereon. In an alternative embodiment, gaming outcome display 28 utilizes a video display (not shown) displaying images of game reels and an image of at least one pay line. A video display may also display game symbols in many other formats and arrangements, such as playing cards. Of course, the invention is not limited to any particular type of gaming outcome display 28. Those of skill in the art will recognize that many different types of gaming outcome displays could be substituted without departing from the scope of the present invention.

Gaming apparatus 10 may include a second display 12 configured to display at least one game and prize to a player. In at least one embodiment, second display 12 is configured to display a bonus game and at least one bonus prize to the player. In other embodiments, second prize display 12 may provide a primary game. Alternatively, second prize display 12 may be a stand-alone device allowing a player to place a wager and play a game.

In at least one embodiment, second display 12 is attached to gaming device 14 and positioned on top of gaming device 14. In other embodiments (not shown), second display 12 may be separate from gaming device 14 but in communication with gaming device 14. In this embodiment, second display 12 may be in communication with a plurality of different gaming devices 14 via a computer network in a manner that is well known in the art. Second display 12 may also be positioned adjacent to or remote from gaming device 14. In other embodiments, second display 12 is a stand-alone display not in communication with gaming device 14, and it may be capable of independently accepting wagers, conducting games, and awarding prizes to a player.

With continued reference to FIG. 1*a*, second display 12 may comprise a housing 40. Housing 40 may be arc-shaped and comprise a plurality of walls defining an internal space or cavity. Of course, housing 40 may be made in many different shapes. Second display 12 also may have an indicator 43. Indicator 43 may be a variety of indicators, including two and three-dimensional indicators.

Indicator 43 and display device 42 may be positioned within housing 40. Indicator 43 may be configured to move vertically (up and down) relative to second display 12 in response to signals sent either by a controller (not shown) or a combination of an input device (not shown) and a controller (not shown). The number of indicators 43 may vary, and the direction of their movement may vary, and may include horizontal, zigzag, and/or diagonal movements.

The shape or appearance of indicator 43 may be designed in various forms and preferably according to a theme of a game. In the example shown in FIG. 1*a*, the theme of the game is a gaming device that awards players with vacations. Accordingly, indicator 43 is in the form of a vacationing person in a swimming outfit and in a swimming floatation tube. Indicator 43 may include a pointer portion 64. Pointer portion 64 may be configured to point to at least one indicium 44. Alternatively, indicator 43 may itself be a pointer, such as an arrow. The present invention is not limited to any particular type of indicator or pointer, or any particular representation of an indicator or pointer.

Indicia 44 may be affixed, imprinted, engraved, or otherwise represented on a display device 42. Display device 42 may have indicia 44 arranged in rows 44*a-c*. Each row 44*a-c* may include multiple indicia 44. Indicia 44 may represent various things, including prize amounts, multipliers, a description or representation of merchandise or services, progressive prizes, or jackpot prizes. In the embodiment shown in FIG. 1*a*, display device 42 is configured to present moveable indicia 44, which may move in various directions. As shown in FIG. 1*a*, indicia 44 move horizontally, or on a rotational axis parallel to the vertical movement of indicator 43. Of course, indicia 44 could be configured to move up and down, that is, display device 42 may have a horizontal rotational axis.

Certain embodiments of the present invention may provide display devices 42 with indicia 44 moving on a first axis and an indicator 43 moving on a second axis, wherein the moveable indicator 43 is able to indicate an indicia 44 on the display device, which may be configured to move on an axis orthogonal to the axis of indicator 43.

Figure 1B:
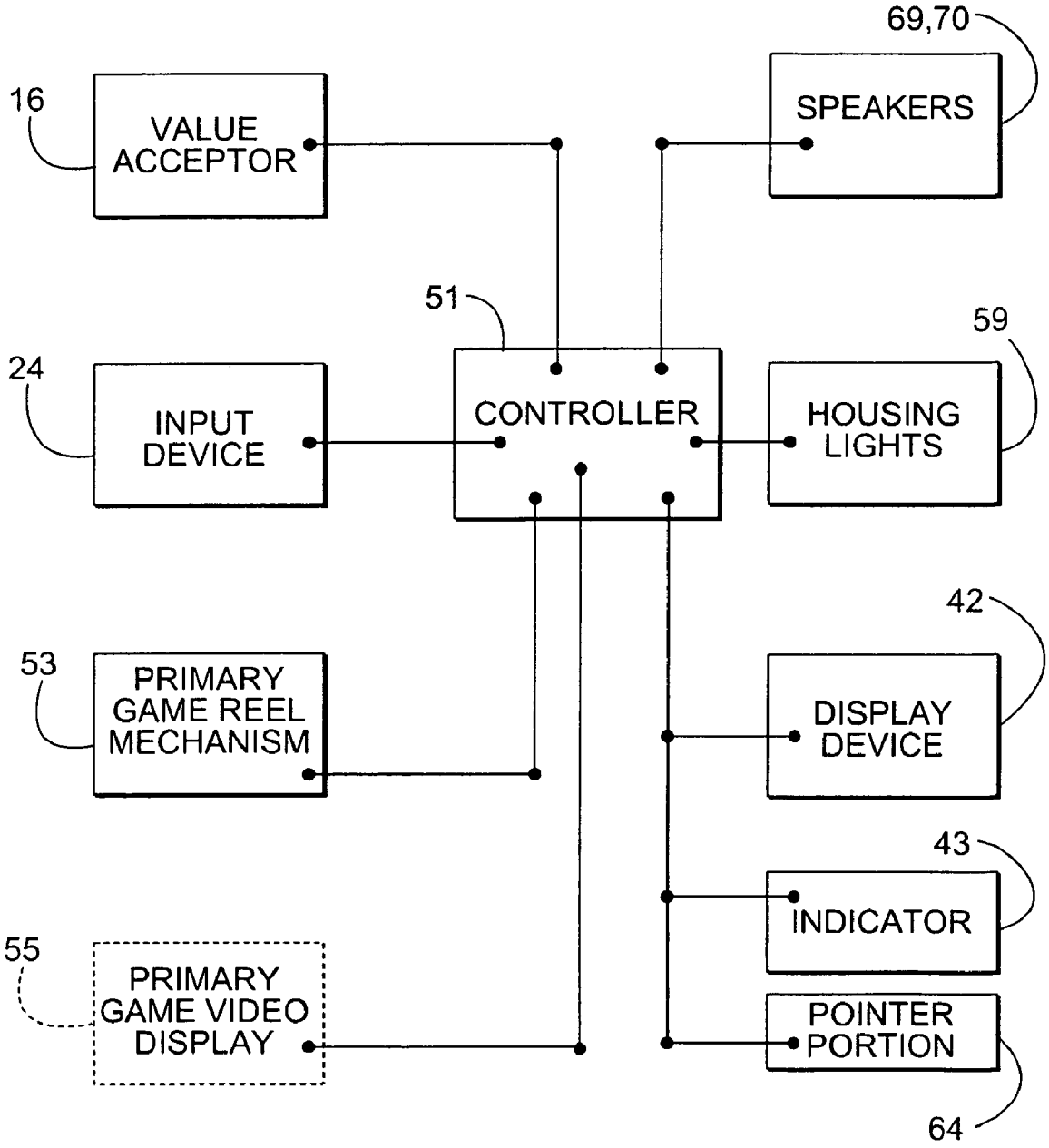
FIG. 1*b* is substantially a schematic diagram showing components of an embodiment of the gaming apparatus.

Referring now to FIG. 1*b*, a schematic diagram of some components that may be included in certain embodiments of gaming apparatus 10 (FIG. 1*a*) is shown. Gaming apparatus 10 may include a value acceptor 16 configured to accept value from the player in the form of paper currency, coins, player cards, tickets, vouchers, tokens, or other forms of value. Value acceptor 16 may be in communication with controller 51. Controller 51 may be in communication with an input device 24. Controller 51 may detect insertion of value into value acceptor 16 and may prompt the player to start a game by activating input device 24. Once controller 51 senses a signal to start the game, controller 51 may be configured to produce a random number and activate reel mechanism 53 of gaming device 14. Reel mechanism 53 may be configured to display indicia (including symbols, characters, numbers, letters, pictures, and the like) on reels 30, 32, and 34 according to the random number generated by controller 51. Alternatively, controller 51 may be configured to produce a random number and activate video display of reels 55 of gaming device 14. The video display of reels 55 may be configured to display indicia in video form according to the random number generated by controller 51. The primary game of gaming device 14, whether in physical form or in video form, is not limited to reel-type games, but may include card games, dominoes, roulette, craps, baccarat, and other games.

Gaming apparatus 10 may further include speakers 69 and 70, housing lights 59, display device 42, indicator 43, and pointer portion 64 in communication with controller 51. Controller 51 may store bonus event information and may have the ability to detect bonus events.

Upon an occurrence of a bonus event, controller 51 may activate speakers 69 and 70, housing lights 59, and display device 42, which causes indicia 44 to move. Controller 51 may cause indicator 43 to move around an area adjacent to display device 42. Controller 51 may then cause indicator 43 to stop, and pointer portion 64 to point to an indicia 44 on display device 42. Housing lights 59 and speakers 69 and 70 together may create a festive and lively winning atmosphere to elicit interest and entertainment from both the player and adjacent patrons.

In at least one embodiment, when gaming apparatus 10 is not in use, indicator 43, housing lights 59, and display speakers 60 may be activated by controller 51 in an attract mode. Housing lights 59 may operate, blink or flash, and indicator 43 may dance or move in a choreographed manner according to music coming from speakers 56. It may be desirable that indicator 43 not point to an indicia 44 at the conclusion of the attract mode in order that players close to gaming device 10 do not mistakenly believe they are entitled to a prize. Controller 51 may activate display device 42 and indicator 43 upon the occurrence of a bonus event.

Figures 2A, 2B:
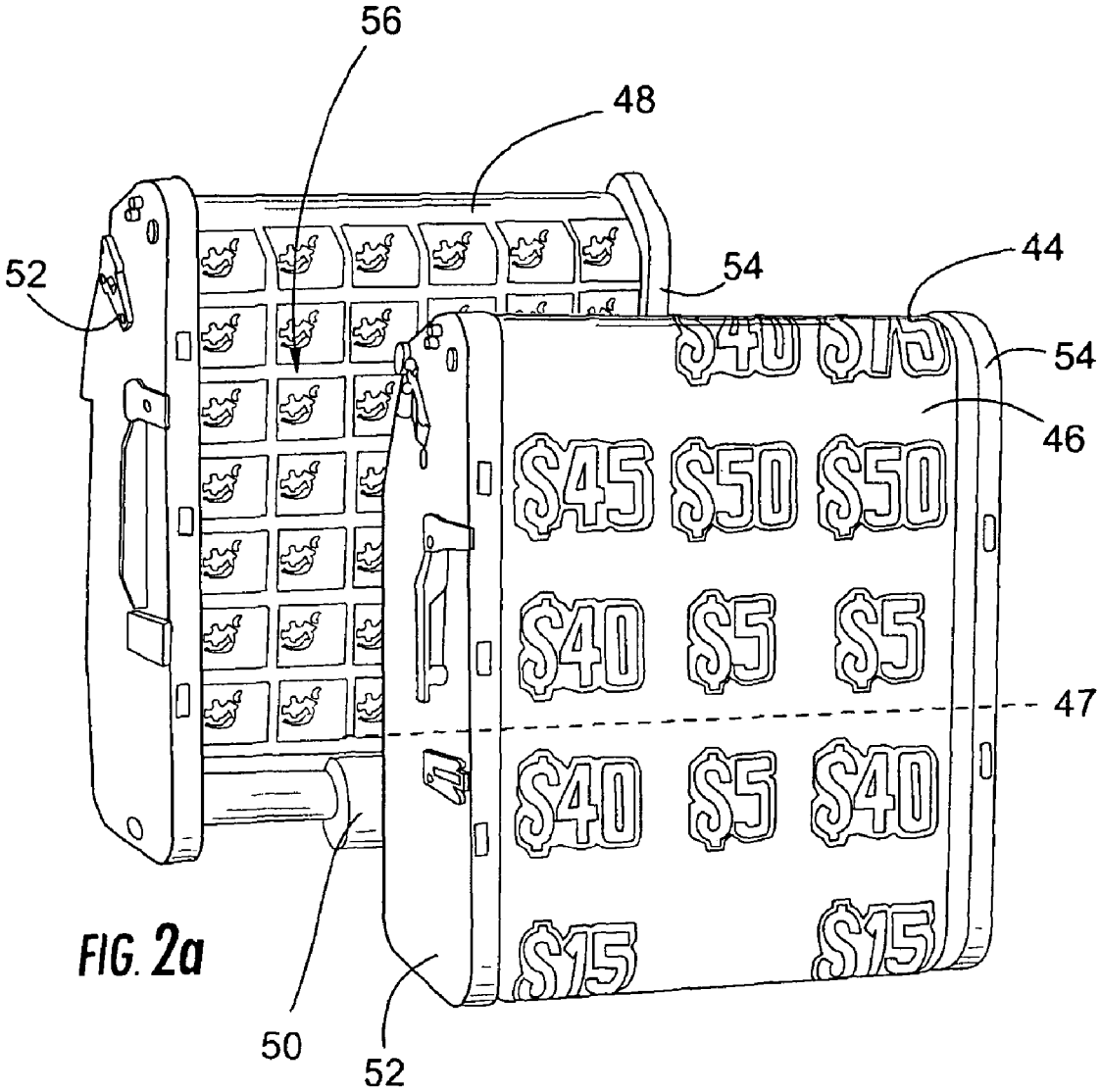
FIG. 2*a* is substantially a partial perspective view of an embodiment of a display device of a prize display.
FIG. 2*b* is substantially a perspective view of the display device shown in FIG. 2*a* with a band on which indicia are affixed.

Referring now to FIGS. 2*a* and 2*b*, in at least one embodiment, display device 42 (FIG. 1*a*) comprises a flat piece of material or band 46 wrapped around a plurality of rollers 48 and 50. Rollers 48 and 50 rotate band 46 about an axis 47. Rollers 48 and 50 may be rotatably connected to chassis 52 and 54 and may be connected to an actuator (not shown). Band 46 has indicia 44 thereon. Indicia 44 may be affixed to band 46 by various methods. Indicia 44 may be imprinted on band 46 in different configurations depending on the desired appearance of indicia 44 when band 46 is presented on second display 12. In the embodiment shown in FIG. 1*a*, band 46 may move from left to right relative to second display 12 or vice-versa. Thus, indicia 44 are displayed in horizontal rows.

In at least one embodiment, a light matrix 56 is positioned behind band 46 to back-light indicia 44. Light matrix 56 may comprise light emitting diodes (LEDs), fluorescent lights, incandescent lights, or other illumination devices that may make band 46 more attractive. A suitable display device 42 may be obtained from Starpoint Electronics Ltd. of Chessington, UK (model FM2).

In another embodiment, display device 42 may comprise at least one conventional reel assembly (not shown). A conventional reel assembly typically includes at least one chassis, an axle attached to the chassis, and a reel attached to the axle. The reel and chassis are typically coupled to an actuator that drives the axle, thereby rotating the reel. The reel typically has a strip of material attached to the circumference of the reel. Indicia are typically affixed to the strip of material by methods known in the art. Conventional reel assemblies may be joined in series, typically in a set of three.

The reel assembly may be positioned within housing 40 (FIG. 1*a*) so that the reel rotates about either a horizontal or vertical axis. Display device 42 may utilize the reel assemblies described in co-pending U.S. application Ser. No. 09/894,197, filed Jul. 27, 2001 and U.S. application Ser. No. 09/968,952, filed Oct. 1, 2001, which are incorporated herein by reference. U.S. application Ser. No. 09/894,197 discloses reel shelf assemblies arranged vertically so that each reel rotates about a vertical axis. U.S. application Ser. No. 09/968,952 discloses reel shelf assemblies having reels that are positioned at an angle relative to each other, side-by-side so that their chassis are away from the two reels positioned adjacent to each other, or combinations thereof.

Figure 3:
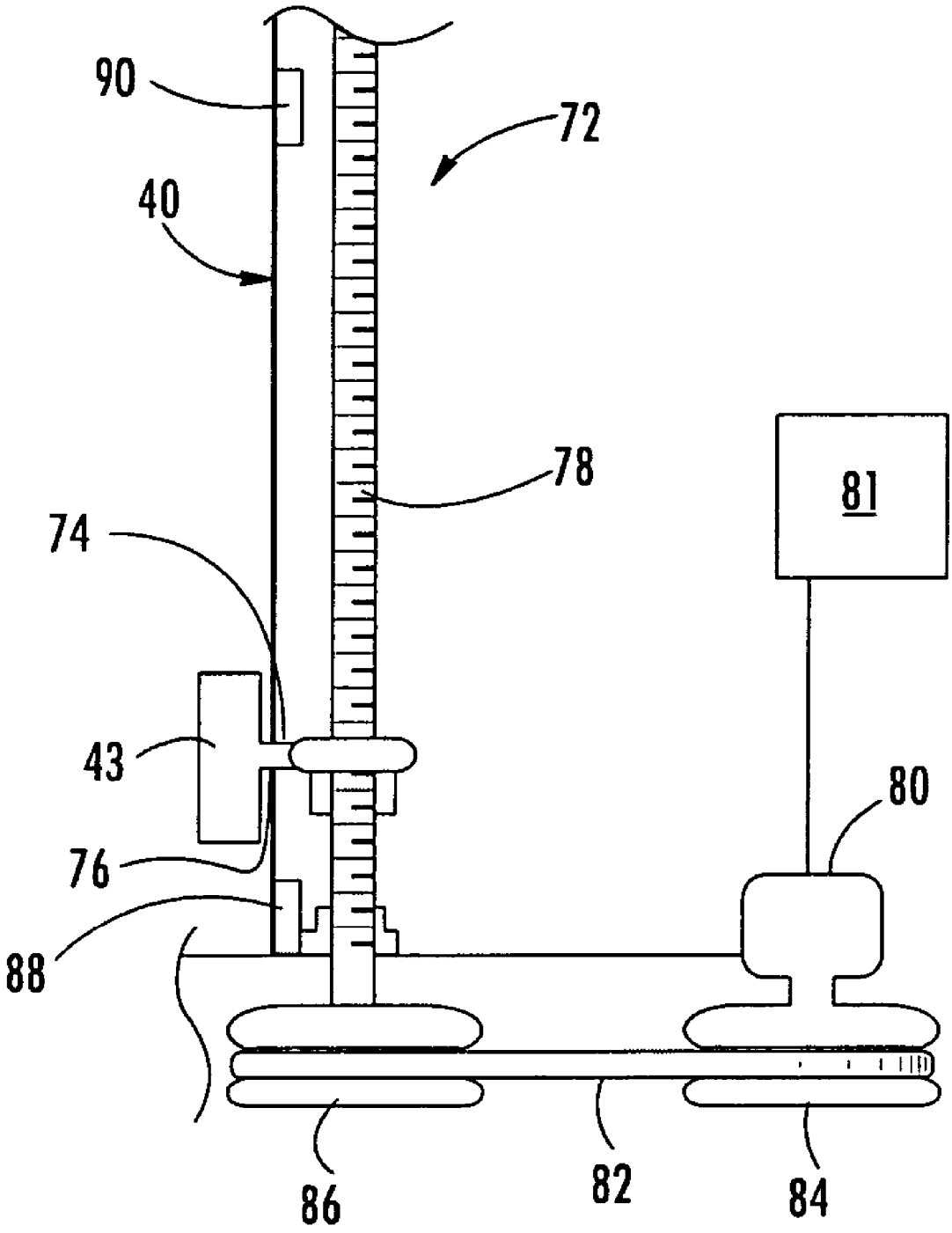
FIG. 3 is substantially a side elevation view of one embodiment of a positioning mechanism of the present invention.

Referring now to FIG. 3, indicator 43 (FIG. 1*a*) may be coupled to a positioning mechanism 72 by a bracket 74. Positioning mechanism 72 may be located within the confines of housing 40. A slot 76 in the front wall of housing 40 may be provided, which allows bracket 74 to pass through the front wall. Positioning mechanism 72 may comprise a worm gear 78 rotatable by an actuator 80. In at least one embodiment, actuator 80 is attached to a first wheel 84. Worm gear 78 may be attached to a second wheel 86. A drive belt 82 preferably rotates around the first wheel 84 and second wheel 86, thereby connecting actuator 80 and worm gear 78. Positioning mechanism 72 may communicate with a controller 81, which may store information regarding pre-determined positions of band 46 of display device 42. Sensors 88 and 90 are preferably in communication with controller 81 and may be provided to allow controller 81 to detect the position of indicator 43. Other devices may be used to detect the position of indicator 43, such as optical readers and the like.

Figure 4:
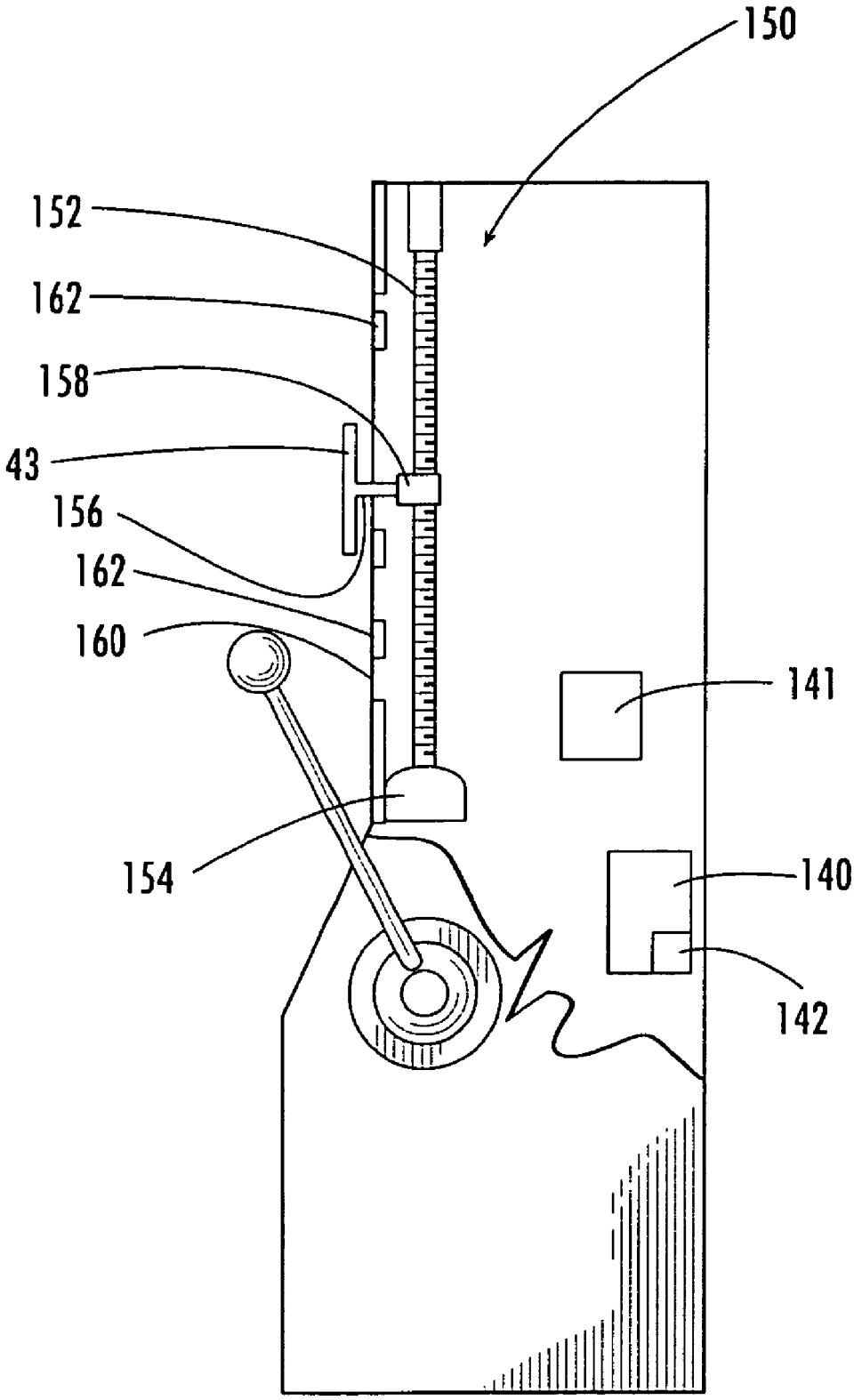
FIG. 4 is substantially a partial cross-sectional view of the gaming apparatus of FIG. 1*a*.

Referring now to FIG. 4, another embodiment of a positioning mechanism 150 is shown. Positioning mechanism 150 may be a vertically positioned worm gear 152 that is caused to rotate by an actuator 154. Indicator 43 may be attached to worm gear 152 by a bracket 156 that is attached to a nut 158 threaded on worm gear 152. A slot 160 may be provided in the front wall of second display 12 (FIG. 1*a*), which allows bracket 156 to pass through the wall. Sensors 162 may be provided to allow controller 140, or other control mechanisms (not shown), to detect the position of indicator 43. While indicator 43 is shown to move vertically in FIG. 4, it may be moved in any desired manner, including horizontally, diagonally, or in a non-linear fashion, such as in a rotating or zigzag manner.

In another embodiment, a wheel (not shown) may be attached to actuator 154. The periphery of the wheel may have at least one notch detectable by a sensor (not shown) and used by a bonus game controller 141 or a game controller 140 to monitor the position of indicator 43. Wheel and worm gear 152 may be rotated together by actuator 154. The sensor monitors the position of indicator 43 by detecting the notch. Bonus game controller 141 or game controller 140 may store information pertaining to the number of times the sensor has detected the notch and the corresponding position of moveable indicator 43. An optical interrupt (not shown) may be provided to reset the indicator position information. The sensor may be an infrared source and detector. In alternative embodiments, the periphery of the wheel may comprise portions with different reflective characteristics, such as absorbent paint lines, instead of a notch on the wheel. Actuators 80 (FIG. 3) and 154 may be a stepper motor, a servo motor, a gear motor, a solenoid, a rack and pinion, or other actuators known in the art.

With continued reference to FIG. 4, an electronic controller 140 that utilizes a random number generator 142 may control gaming device 14 (FIG. 1*a*). Random number generator 142 produces a random or pseudo random number for each game. The outcome of the game may be determined by comparing the random number produced by random number generator 142 to a table of outcomes stored in a memory and accessed by controller 140. A number of different tables of outcomes may be used and different tables may be used for different games. The tables can be designed so that different prizes have different probabilities of being awarded. Such design techniques are well known in gaming and are described above. Examples of such designs are shown in U.S. Pat. No. 4,448,419, issued to Telnaes, and U.S. Pat. No. 5,456,465, issued to Durham, which are hereby incorporated by reference. Controller 140 may cause gaming outcome display 28 (FIG. 1*a*), e.g., game reels 30, 32, and 34, to show the display an outcome that corresponds to the random number generated by random number generator 142. Of course, gaming device 14 may operate in many other ways and still achieve the objects of the present invention.

Gaming device 14 may also be capable, via controller 140 or other control mechanism (not shown), of producing a bonus-activating event. This event may be many different types of events. For example, a bonus-activating event may comprise a game outcome such as displaying a particular symbol, e.g., a "bonus" symbol, or combination of symbols, such as a "7" symbol on each of reels 30, 32, and 34 (FIG. 1*a*). If the game being played is poker based, the bonus-activating event may be an occurrence of a certain hand, such as a royal flush. Furthermore, a bonus-activating event may occur when a player accumulates a number of symbols or game outcomes over a number of separate game plays. For example, a bonus-activating event may occur when the player receives three "bonus" symbols during a period of time. The bonus-activating event may be based on an external event. For example, a bonus-activating event may occur when a group of players obtain a certain result. Sensors (not shown) may be provided external to gaming device 14 to detect external bonus-activating events.

Bonus game controller 141 may further be provided to detect when a bonus activating event occurs in gaming device 14. Gaming device controller 140 may determine the outcome of each game, and when a bonus-activating outcome occurs, gaming device controller 140 may transmit a signal to bonus game controller 141. Alternatively, bonus game controller 141 may periodically interrogate gaming device controller 140. Bonus game controller 141 and gaming device controller 140 may be a single controller or separate controllers. In at least one embodiment, gaming device controller 141 is the GAM 2000 controller, available from Eagle Engineering of Pottstown, Pa.

The bonus prize may be determined by a random number generator (not shown) and a virtual pay table, such as the pay table described in U.S. Pat. No. 5,823,874 to Adams, which is hereby incorporated by reference. A simple pay table may also appear as follows:

TABLE 1

| Random Number | Amount Paid |
|---|---|
| 0.00 to 0.50 | $10.00 |
| 0.51 to 0.75 | $50.00 |
| 0.76 to 0.95 | X2 |
| 0.96 to 1.00 | $10,000.00 |

For example, if the random number generator produced 0.45 as the game outcome, the controller may cause indicator 43 (FIG. 1*a*) to stop and pointer portion 64 (FIG. 1*a*) to point to an indicia representing ten dollars. Alternatively, if the random number generator produced a value of 0.85, the controller may cause indicator 43 to stop and pointer portion 64 to point to an indicia 44 representing a multiplier of 2. The controller may then cause bonus meter 68 (FIG. 1*a*) to display "10×2=20," (assuming a base prize of ten dollars) and $20.00 would be awarded to the player.

The bonus selection process may be repeated for a predetermined number of times to accumulate several bonus prizes that are added to form the award to the game player. For example, the bonus game could be repeated three times to accumulate an award. The present invention is not limited to the example pay table shown. Furthermore, different kinds of bonus prizes may be awarded, such as progressive prizes, jackpot prizes, merchandise, services, prize multipliers, and additional games. Other effects may also be presented, such as pre-recorded sound from speakers 69 and 70 (FIG. 1*a*).

Speakers 69 and 70 may be configured to announce a prize a player has won, play music during a prize winning event, announce features of the game offered by gaming apparatus 10, or play music to attract and entertain patrons. Additionally, a variety of graphics and lights, preferably designed according to a particular theme, are displayed on prize display 12 (FIG. 1*a*). If the awarded bonus prize is money, the amount of the bonus prize may be added to the player's credit meter (not shown), may be dispensed to the player via a voucher or other cashless device, may be dispensed to coin receptacle 20 (FIG. 1*a*), or an attendant may be summoned to award the prize to the player.

Figure 5:
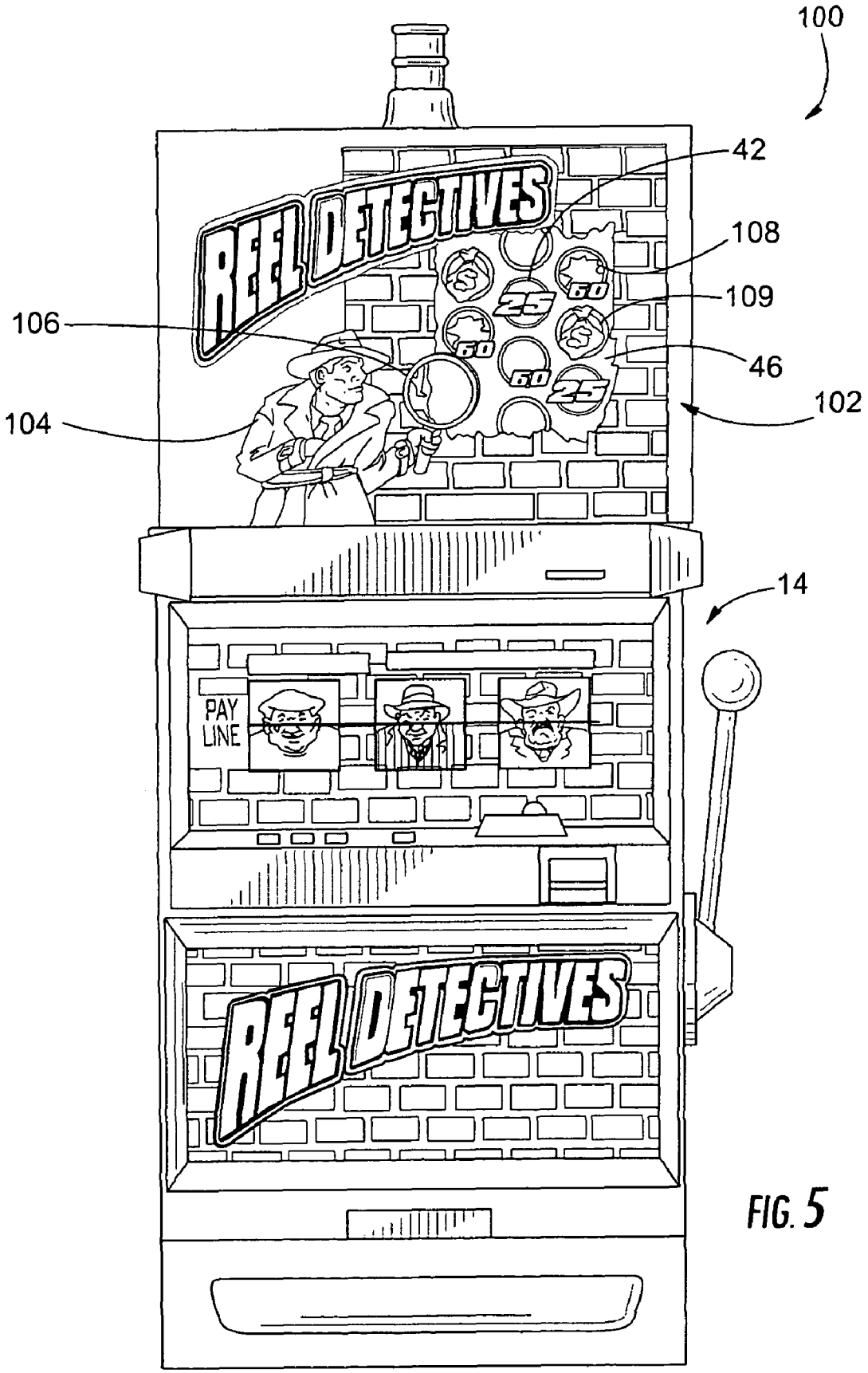
FIG. 5 is substantially a front elevation view of an embodiment of a gaming apparatus of the present invention.

Referring now to FIG. 5, another embodiment of a gaming apparatus 100, similar to gaming apparatus 10 (FIG. 1*a*), is shown. Prize display 102 of gaming apparatus 100 may comprise display device 42. In this embodiment, band 46 is configured to move vertically around a horizontal axis of rotation. Prize display 102 also may comprise an indicator 104 that is similar to indicator 43 (see FIG. 1*a*). Indicator 104 may have an appearance that conforms to a theme of the game, which is a detective game in this embodiment. Thus, indicator 104 may look like a detective, such as a man wearing a trench coat and a hat. In the embodiment illustrated in FIG. 5, indicator 104 moves horizontally. Indicator 104 may have a pointer portion 106. As shown in FIG. 5, pointer portion 106 is in the form of the detective's magnifying glass. The magnifying glass may be real or fake. If it is desired to have a functioning magnifying glass, the magnifying glass may comprise a standard magnifying lens, a fresnel lens, or other device known in the art. Pointer portion 106 may be configured to substantially cover an indicia selected by the controller (not shown) and magnify the indicia for the player to see. The mechanism for driving indicator 43, described above and shown in FIGS. 3 and 4, may be used for driving indicator 104.

Figure 6:
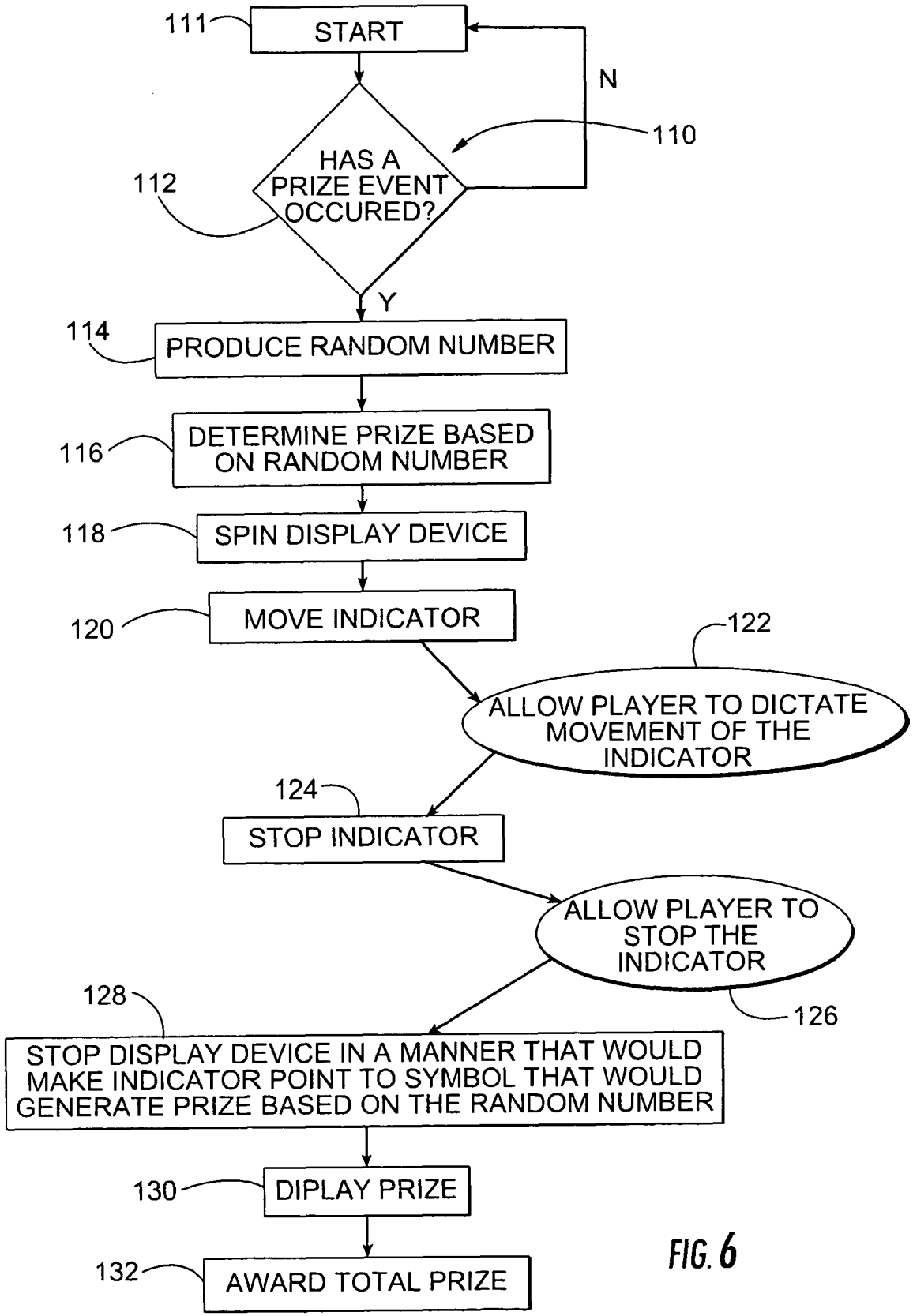
FIG. 6 is substantially a flowchart of a gaming method of the present invention.

Referring now to FIG. 6, a gaming method 110 is shown wherein a controller, such as controller 51, 81, 140 or 141, determines whether a prize event has occurred in step 112. If a prize event has occurred, the controller produces a random number at step 114. At step 116, the random number may be used to select a prize. At step 118, the controller may activate display device 42. At step 120, the controller may cause indicator 43 or 104 to move. Optionally, at step 122, the controller may allow a player to control the movement of indicator 43 or 104 by prompting the player to press one or more buttons (such as a button to move indicator 104 right and a button to move indicator 104 left) or another input device, such as a touch-pad, a joystick, or a mouse. At step 124, the controller causes indicator 43 or 104 to stop. Optionally, at step 126, the controller stops indicator 43 or 104 upon the activation of an input device by the player. At step 128, the controller causes the display device 42 to stop in a manner that would make indicator 43 or 104 point to the corresponding symbol that would indicate the prize selected based on the random number previously generated by the controller. At step 130, the prize may be displayed on the bonus meter. Steps 118 to 128 may be repeated a predetermined number of times, and the sum of the prize values may be displayed. Lights and sounds may be generated to create a festive atmosphere. At step 132, a total prize may be awarded to the player. The cumulative prize may be multiplied by a multiplier in order to obtain the total prize. The multiplier may be fixed or randomly determined.

It is noted that the flowchart in FIG. 6 shows only one possible embodiment. Some of the steps in the flowchart may be varied, changed in order, or eliminated and still fall within the scope of the present invention.

Figure 7:
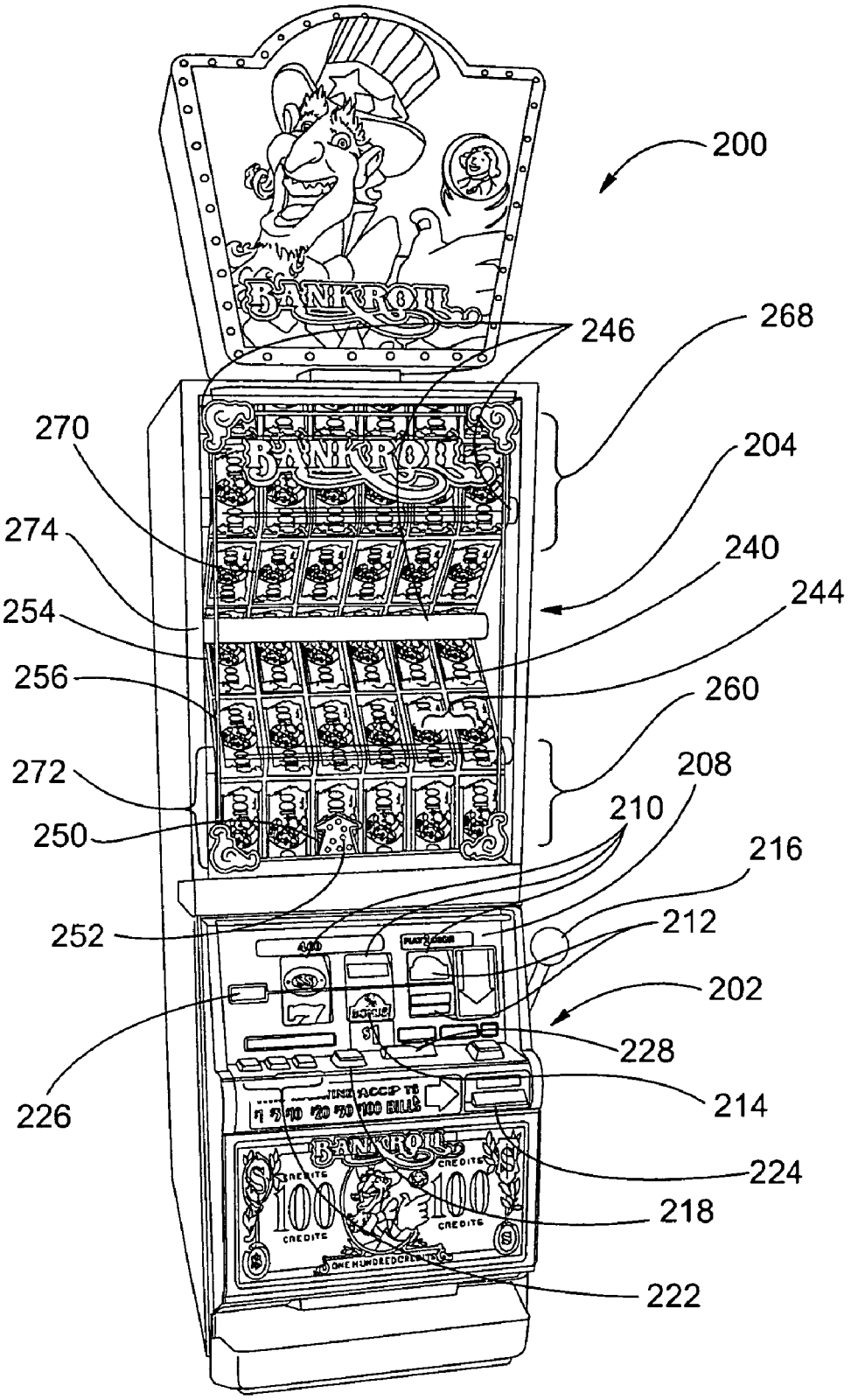
FIG. 7 is substantially a front perspective view of an embodiment of a gaming apparatus of the present invention.

FIG. 7 shows an additional alternate embodiment of a gaming device according to the present invention. FIG. 7 shows a gaming device 200 having a primary gaming device 202 and a gaming display 204, which may display all or part of a bonus game or primary game. Primary game 202 may be configured similarly to previously discussed embodiments, and may include a plurality of mechanical or video reels 210 located on primary game display 208. A plurality of indicia 212 may appear on reels 210. A pay line 226 may be included to assist players in determining whether they have won the game. Value acceptors, including coin acceptor 228 and bill acceptor 224, may be included. The player may activate the game via button 218 or arm 216.

Primary game 202 may operate in conjunction with gaming display 204. The appearance of one or more indicia 212 on pay line 226 may entitle the player to play gaming display 204. An example of bonus qualifying indicia is indicia 214.

Gaming display 204 may contain a band of material 240 that rotates about a plurality of rollers 246. Band 240 may have a plurality of indicia 244 appearing thereon. Indicia 244 may indicate various prizes.

Band 240 may resemble a printing press, including a magazine printing press, a newspaper printing press, and a money printing press. As shown in FIG. 7, a least a portion of rollers 246 are arranged such that band 240 is displayed at a first position 268 of gaming display 204 located towards the front of gaming display 204. Band 244 then may be directed to a second position 270 of gaming display 204, such as passing behind roller 274, where band 240 is located more in an interior portion of gaming display 204. Band 240 may then be directed to a third position 272, which may be in the same plane as first position 268, located towards the front of gaming display 204. In this way, band 240 may appear to be passing through a printing press.

As illustrated in FIG. 7, band 240 appears to be a sheet of uncut paper currency, such as might be produced by the U.S. Treasury Department. Indicia 244 may appear to be currency bills having various values. Indicia 244 may indicate prizes such as an award of currency or credits, merchandise, services, game play, jackpots, and progressive prizes. Band 240 may have a variety of different indicia 244 imprinted, or otherwise appearing thereon.

Band 240 may be constructed from any suitable material. Band 240 may be constructed from a flexible material, such as various types of vinyl, plastic, rubber materials, and the like. The use of a flexible material may prevent band 240 from tearing or creasing when it is moved. The material used to construct band 240 may be transparent or translucent, allowing band 240 to be backlit.

Band 240 may be coupled to a drive mechanism (not shown in FIG. 7) so that band 240 may be rotated about rollers 246. In operation, band 240 may be actuated prior to a bonus prize being awarded to the player. Indicia 244 that may be awarded may appear in a particular area, such as area 260, for display to the player. Display area 260 may be lighted or otherwise brought to the player's attention.

In at least one embodiment, an indicator 250 is included that may point to particular indicia 244. Indicator 250 may be configured to point to an indicia 244 that conveys the outcome of gaming display 204. As shown in FIG. 7, indicator 250 is moveable in a horizontal manner. However, gaming display 204 is not limited to any particular configuration, and indicator 250 may move vertically, diagonally, or in a non-linear manner, as desired by the game designer. Indicator 250 may be lit, such as by lights 252, in order to make indicator 250 more attractive and to call attention to indicator 250. In at least one embodiment, indicator 250 is illuminated only when gaming display 204 is active or when gaming display 204 is in an attract mode (such as has been previously described).

At least one advantage of band 240, as illustrated in FIG. 7, is that it may provide a relatively long path length. Accordingly, it may allow for more and/or larger indicia 244 to be included on band 240.

Figure 8:
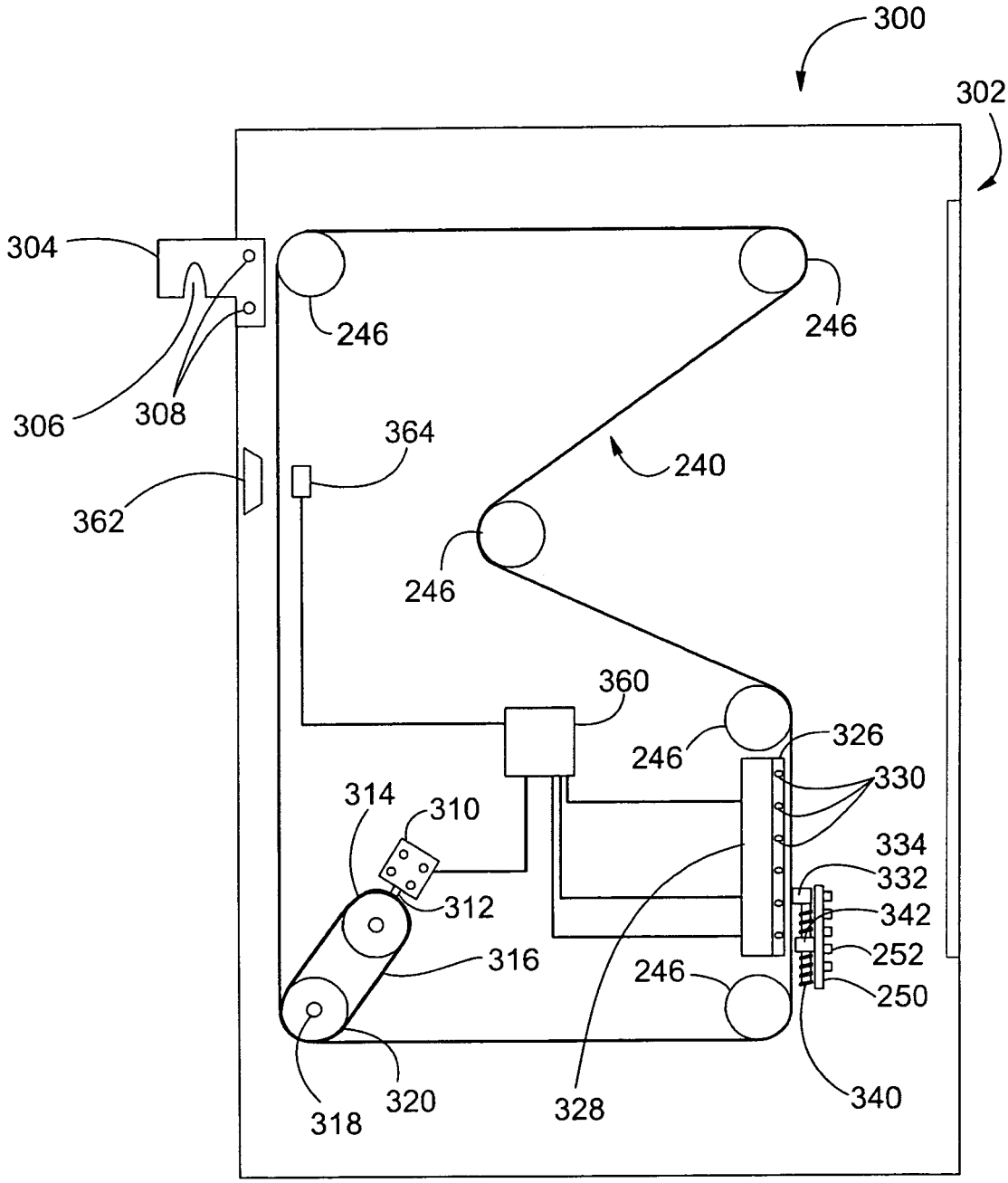
FIG. 8 is substantially a side elevation view of an embodiment of a gaming apparatus according to the present invention.

FIG. 8 illustrates certain components of a band display 300 that maybe included in a gaming device according to the present invention, including that depicted in FIG. 7. FIG. 8 illustrates band 240 wrapped around a plurality of rollers 246. In at least one embodiment, all rollers 246 are idler rollers that simply guide band 240 about the interior of gaming display 204. One suitable roller is model number E8S001-01-ZZZZ available from Starpoint Electronics, Ltd. of Chessington, UK. A driven roller may be included to drive band 240. Driven roller 320 may be in communication with an actuator 310 in order to drive rotation of driven roller 320. One suitable driven roller is model E8S002-01-ZZZZ from Starpoint.

In at least one embodiment, band 240 is driven simply by frictional contact with roller 320. However, other arrangements may be substituted without departing from the scope of the present invention. For example, roller 320 may have a portion with teeth (not shown) that could engage slots or holes (not shown) in band 240.

Actuator 310 may be any number of suitable actuators, such as motors, including stepper motors, gear motors, and servo motors. Actuator 310 may rotate a shaft 312 in connection with a wheel 314. A belt 316 may link wheel 314 to shaft 318 of driven roller 320. Rotation of shaft 312 drives wheel 314 which in turn drives belt 316. The rotational force is passed from belt 316 to shaft 318. Rotation of shaft 318 may drive rotation of roller 320. Frictional contact with rotating driven roller 320 moves band 240. Optionally, an idler wheel or pulley (not shown) can be included on the opposing side of band 240 in order to increase the frictional contact of band 240 with driven roller 320.

In another embodiment, actuator 310 may be a stepper motor rotating a drive gear (not shown). The drive gear may be in communication with a spur gear (not shown) driving an idler shaft (not shown). The idler shaft in turn may be in communication with driven roller 320. The idler shaft may also used to help transfer power to the side of band 240 not located by actuator 310.

In at least one embodiment, band 240 may pass over an area proximate indicator 250. As shown in FIG. 8, indicator 250 may be attached to a worm gear 340. Worm gear 340 may be in communication with a suitable actuator 332, such as a servo motor, stepper motor, or the like. Indicator 250 may be attached to bracket 342. Bracket 342 may be threadably attached to worm gear 340.

In at least one embodiment, indicator 250 includes one more lights 252 in order to call attention to indicator 250 and make indicator 250 more attractive. Lights 252 may be of any suitable type, including light emitting diodes (LEDs). Both lights 252 and indicator actuator 332 may be in communication with a controller, such as controller 360.

Controller 360 may direct lights 252 to illuminate and deactivate in accordance with game events, such as the execution of an attract mode, or a game outcome qualifying a player to play gaming display 204. Controller 360 also may direct the movement of indicator 250. For example, controller 360 may move indicator 250 upon activation of gaming display 204. Controller 360 may direct indicator 250 to stop, such as when a player activates buttons 222.

Controller 360 also may determine the position of indicator 250, for example if the controller is preset with the starting position of indicator 250, controller 360 may track the position of indicator 250 by knowing in which direction (or directions) indicator 250 was moved, how fast it was moved, and for what period of time. Depending on the actuator 332 used, actuator 332 may provide feedback as to the position of indicator 250 (for example, if an indexing stepper motor is used).

It may be beneficial to provide an additional position sensor for indicator 250. Those of skill in the art will recognize that various types of sensors could be used to track the position of indicator 250. In one embodiment, optical sensors are used. For example, an infrared signal generator may be included on one side of worm gear 340. An infrared detector may be placed on the other side of worm gear 340. When indicator 250 is not in between the generator and detector, the detector detects the infrared signal. When indicator 250 is interposed between the signal generator and detector, the detector does not detect a signal. Therefore, when the signal is interrupted, controller 360 knows the position of indicator 250. Such a positioning system may be a useful way to calibrate indicator 250.

Of course, other systems can be used, or additional signal generators and detectors used, including those that may allow for constant tracking of indicator 250. For example, an optical sensor may be attached to bracket 342. Optical readable indicia and patterns may be placed along worm gear 340. As bracket 342 travels along worm gear 340 the sensor may read the indicia or patterns and communicate the position of indicator 250 to controller 360.

Controller 360 may also be in communication with a housing 328 that may have a plurality of lights 330. Lights 330 may be any suitable illumination device, including LEDs, fluorescent lamps, and incandescent lamps. Lights 330 may be activated by signals sent from controller 360 in response to game events. Lights 330 may be used to backlight band 240. Illumination of band 240 may result in a more appealing look for gaming display 204 and call more attention to the area of band 240 on which indicator 250 may indicate a prize.

Housing 328 may also contain a guide 326. Guide 326 may provide a surface to help position band 240. For example, guide 326 may help maintain band 240 in a taut position, and keep band 240 from wrinkling, creasing, tearing, or getting caught in any of the actuating mechanisms, including the actuating mechanism for indicator 250.

Controller 360 may also be in communication with a positioning system for band 240. It may be beneficial to be able to track the position of band 240. For example, when a game outcome is determined, it is important to make sure that indicator 250 points to the appropriate indicia on band 240.

Many suitable positioning systems can be used, including those used for indicator 250. For example, an infrared signal source 362 can be included on one side of band 240. An infrared detector 364 may be located on the opposing side of band 240. Infrared blocking materials may be placed at one or more locations on band 240. By tracking when the infrared signal is blocked, controller 360 may be able to calibrate and/or constantly track the position of band 240 and any indicia appearing thereon.

In an alternative embodiment, a side of band 240 contains a series of holes (not shown), cut-out portions, or similar optical interrupts. The optical interrupts may be read by an optical reader (not shown). The optical interrupts may convey the position of band 240 to controller 360.

Of course, gaming display 204 may be calibrated by the gaming operator from time to time, and position data from actuator 310, such as an indexing stepper motor, may also be used to track the position of band 240.

Figure 9:
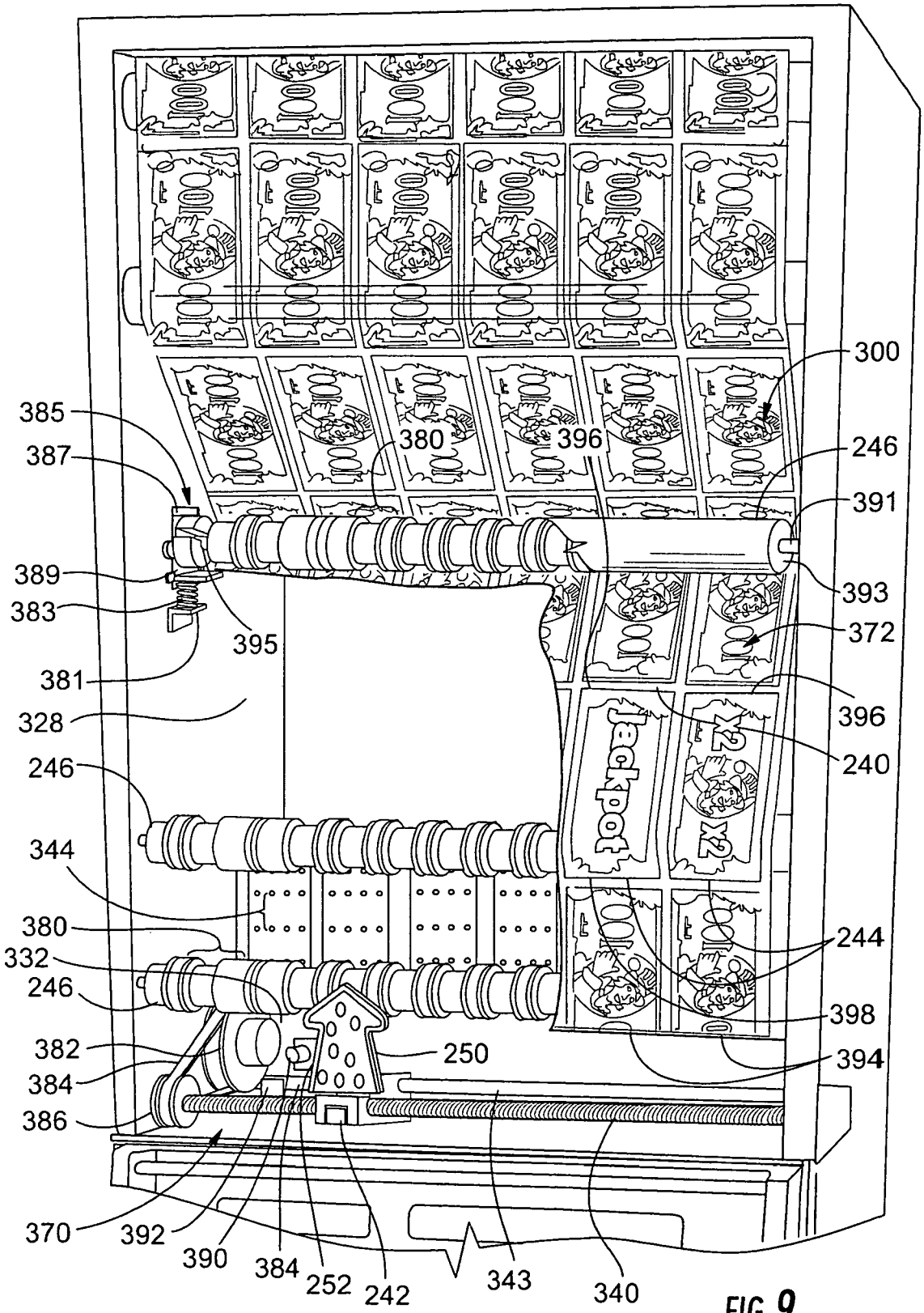
FIG. 9 is substantially a front view of a gaming apparatus according to the present invention, including a cut away view showing the interior of the gaming apparatus.

In at least one embodiment, the components of band display 300 shown in FIGS. 8 and 9 are modular in nature. That is, band 240, indicator, 250, and their actuating mechanisms may be added and removed from a gaming device as a unit. For example, as shown in FIG. 8, a hook 304 having a slot 306 may be attached to the frame of band display 300, such as by fasteners 308, such as bolts or rivets. A receiver (not shown), such as a bar, may be provided within the gaming device for attachment to hook 304.

FIG. 9 presents an alternate view of a gaming device according to the present invention. Portion 370 is a cut away view of the inner portion of an embodiment of gaming display 204. Portion 372 is an outer view of the embodiment.

In FIG. 9, it can be seen that in at least one embodiment, rollers 246 are fitted with a plurality of wheels 380. Wheels 380 may be made of a material that maintains strong frictional contact with band 240. Wheels 380 are preferably constructed of, or coated with, a relatively non-abrasive material so as not to damage band 240. For example, wheels 380 may be made of various types of rubber, plastic, and similar materials.

Rollers 246 may be provided with a tensioning system that may both help maintain the position of rollers 246, and maintain pressure on rollers 246 in order to ensure that band 240 is taut. The tensioning system may include a base 381, which may be mounted to the frame of gaming display 204 (FIG. 7). Base 381 may be coupled to a biasing device 383, such as a spring. Biasing device 383 may be coupled to a moveable mounting area 385. Moveable mounting area 385 may be moved along a track 387. Moveable mounting area 385 may include a plate 389 that is mounted to biasing device 383.

Roller 246 may include a pin 391 and a shaft end 393. Pin 391 may be held within roller mounting area 395. Roller mounting area 395 may include a raised area defining a hole (not shown). When roller 246 is inserted, biasing device 389 will push roller 246 against band 240. Roller 246 may then rotate about pin 391 while keeping band 240 taut.

FIG. 9 also provides additional detail for a suitable actuator and positioning system for indicator 250. As was previously described, indicator 250 may be attached to worm gear 340 by bracket 342. Worm gear 340 may be actuated by motor 332. Motor 332 maybe attached to pulley 382 (which may be a timing pulley). Belt 384 (which may be a timing belt) may be attached to pulley 382 (which may be a timing pulley) and in contact with shaft end 386 of worm gear 340. A positioning system, such as infrared signal generator 390 and infrared detector 392, may be included in order to assist in tracking the position of indicator 250. In at least one embodiment, motor 332 is stepper motor model HT23-396, available from Applied Motion Products of Watsonville, Calif.

In at least one embodiment, bracket 342 is configured to resist rotating as it travels along worm gear 340. One way this may be achieved is to include a rail 343 that runs parallel to worm gear 340. Bracket 342 may be coupled to rail 343. Rail 343 will prevent bracket 342 from rotating, while allowing linear movement along worm gear 340.

Turning now to portion 372 of FIG. 9, there is illustrated a number of indicia 244 appearing on band 240. As shown in FIG. 9, indicia 244 are representations of faux paper currency having various representations. Of course, any suitable indicia 244 may be placed on band 240. Indicia 244 may be chosen to be relevant to a theme of gaming device 200, or gaming display 204, such as the "Bank Roll" theme shown in FIGS. 7 and 9.

Indicia 244 may represent prizes that a player may be awarded. For example, indicia 394 may represent an amount of money or gaming credits. Indicia 396 may represent a multiplier by which the player's winnings from one or more gaming rounds may be multiplied. Indicia 398 may represent special awards, such as a good, a service, a jackpot, or a progressive amount. Of course, indicia 244 may represent many other prizes without departing from the scope of the present invention.

In certain embodiments, portion 372 may include a slot 388 (not shown). A portion of indicator 250 or bracket 342 may extend through slot 388. Slot 388 may allow indicator 250 to be displayed to the player, and actuated, but hides the inner workings of gaming display 204 (FIG. 7) from the player. Of course, other means of hiding the inner workings of gaming display 204, including the actuation system for indicator 250, from the player could be used. For example, rather than a slot, the actuation mechanism could be located below the area of gaming display 204 viewable by the player, as shown in FIG. 9. Indicator 250 could be attached to the actuation mechanism in this area, and then extend upward into the area viewable by the player.

As illustrated in FIGS. 7 and 9, in certain embodiments pointer 250 moves along a first axis. Band 240 (which may function as a display surface) moves along a second axis. Indicia 244 appearing on band 240 move along the second axis as band 240 moves. In certain embodiments, the first axis is orthogonal to the second axis. The first and second axis may be used to define a coordinate system, with each indicia 244 appearing on band 240 corresponding to a specific coordinate in the system. Controller 360 may be programmed with the coordinates of each indicia 244, allowing controller 360 to ensure that the proper indicium or indicia 244 corresponding to a game outcome is displayed once band 240 and indicator 250 are stopped.

Figure 10:
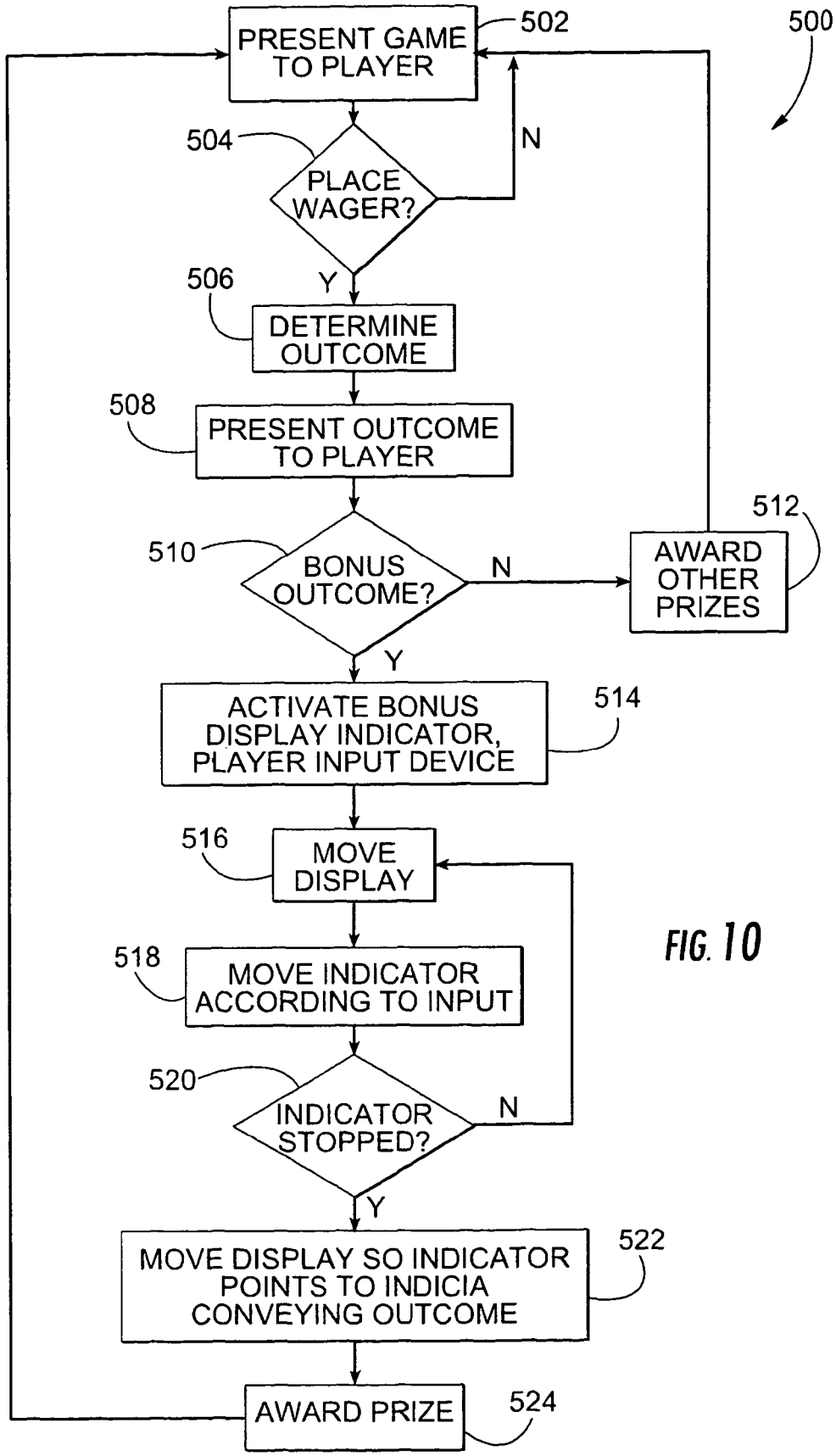
FIG. 10 is substantially a flowchart of a method according to the present invention.

One method of operation 500 of an embodiment of the present invention, such as the device depicted in FIG. 7, is illustrated in FIG. 10. A game is presented to a player in step 502. At decision 504, method 500 checks to see if the player has placed a wager. If not, method 500 returns to step 502.

If the player places a wager at decision 504, method 500 proceeds to determine a game outcome in step 506. The outcome is presented to the player at step 508. At decision 510, method 500 checks to see if the game outcome determined in step 506 is an outcome qualifying the player to play a bonus game. If not, method 500 proceeds to step 512 and awards the player any prizes awarded according the game outcome determined in step 506, and returns to step 502.

If it is determined in step 510 that the game outcome of step 506 qualifies the player for a bonus game, method 500 proceeds to step 514. At step 514, gaming display 204 is activated. This may include activation of band 240, indicator 250, and player input device 222. Lights and sounds may also be activated to make the event more exciting to the player and those around the player, as well as to call attention to the device.

Method 500 then proceeds to step 516 where band 240 is actuated. The player may be allowed to control the movement of indicator 250 using input device 222. For example, in the device depicted in FIG. 7, the player may be allowed to move the indicator left and right, and to stop the indicator at a desired location.

Method 500 proceeds to decision 520, which checks to see whether indicator 250 has been stopped. If indicator 250 has not been stopped, method 500 returns to step 518 and continues to move band 240 and allow the player to move indicator 250.

If decision 520 determines that the player has stopped indicator 250, method 500 proceeds to step 522. At step 522, a controller (which may be controller 51, 81, 140, 141, or 360) continues to move band 240 until the indicia corresponding to the game outcome is indicated by indicator 250. Method 500 then awards any prizes to the player in step 524 and returns to step 502.

Of course many variations of this method can be made without departing from the scope of the present invention. For example, the game outcome determined in step 506 can include both the outcome of the primary game and the bonus game. Alternatively, the bonus game outcome can be determined in a separate step once the bonus game begins.

FIG. 10 illustrates a method where band 240 moves at the same time a player is positioning indicator 250. In another embodiment, band 240 may be stationary while the player positions indicator 250. Once the player has chosen a position for indicator 250, band 240 can be moved until the appropriate indicia is indicated by indicator 250.

The player could be allowed to select the position of indicator 250 in a variety of ways. For example, the player could be provided with directional buttons and a stop button. Alternatively, indicator 250 could be moved in an automated fashion by controller 360. The player could activate a stop button when indicator 250 is at the position the player desires.

As may be apparent from the above description, it may be desirable to arrange indicia 244 on band 240 such that enough of each type of indicia 244 are included in order that any indicia can be indicated by indicator 250 at any position to which indicator 250 is moved. For example, in the embodiment illustrated in FIG. 7, indicia 244 are illustrated as appearing in a matrix of rows and columns, with indicator 250 being positionable at a particular column. Accordingly, it may be beneficial to have each at least one indicia 244 representing each prize that may be awarded appear on at least one row of each column of band 240.

Figure 11:
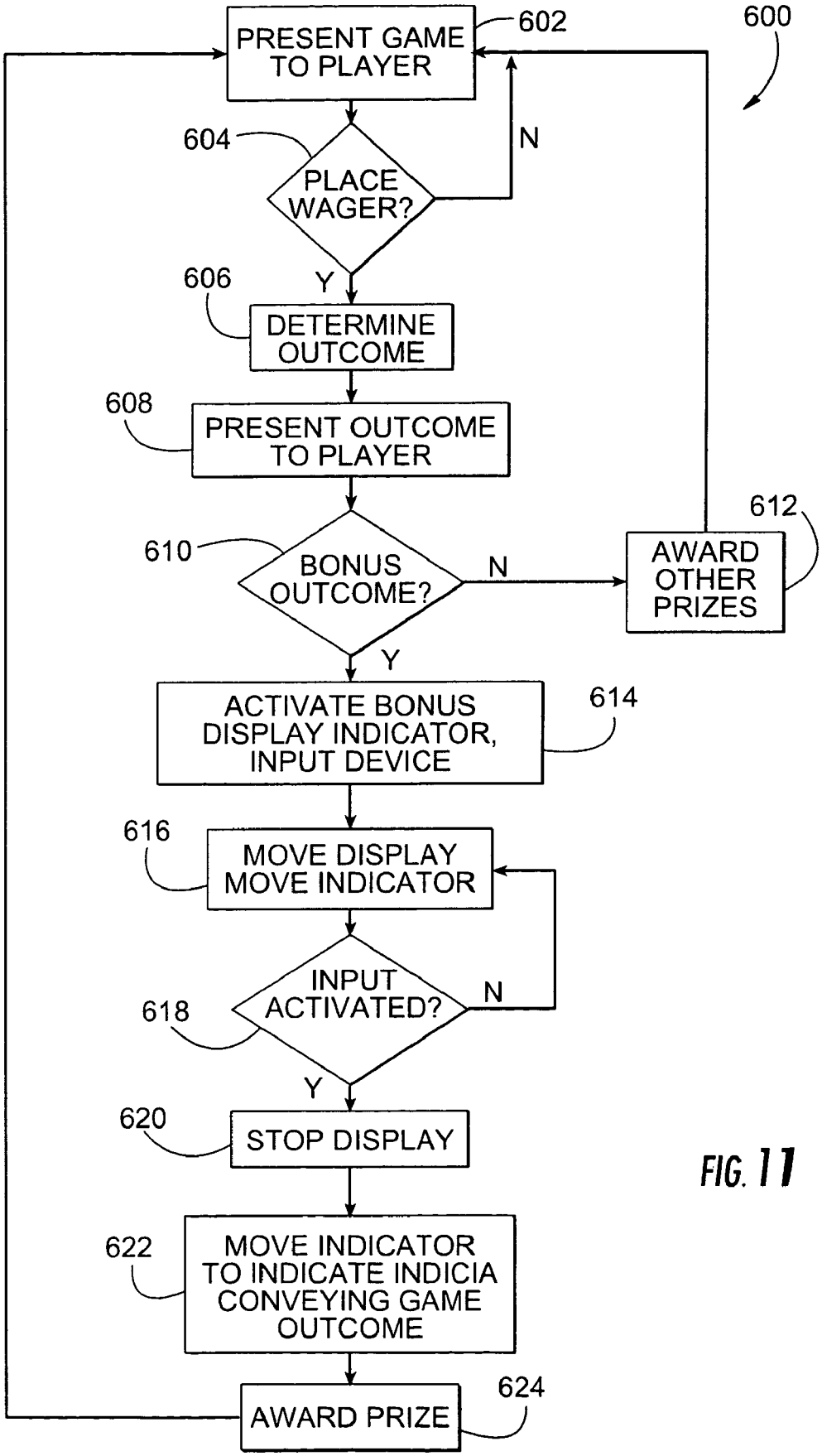
FIG. 11 is substantially a flowchart of a method according to the present invention.

An alternative method of operation is illustrated in FIG. 11. Steps 602-612 may correspond to steps 502-512 described above. At step 614, gaming display 204 may be activated, including band 240, indicator 250, and player input device 222. Lights and sounds may be activated, as previously described. Band 240 and indicator 250 are moved at step 616.

Decision 618 checks to see whether input device 222 has been activated. If input device 222 has not been activated, method 600 returns to step 616. If input device 222 has been activated, band 240 is stopped at step 620. Band 240 may be stopped quickly or may gradually come to a stop.

Method 600 then proceeds to step 622. At step 622, indicator 250 is moved to indicate the indicia conveying the outcome of the bonus game. Any prizes are awarded in step 624, and then method 600 returns to step 602.

Method 600 may be configured to allow a player to stop band 240 in a specific position, or simply to choose when band 240 will begin to stop. If the player is allowed to choose a specific position for band 240, it may be desirable to have at least one of each prize represented by indicia 244 that may be awarded appear on each row of band 240. Of course, if the player may not choose the exact position of band 240, it may be less desirable to include every indicia 244 on each row. Indeed, not allowing the player to choose an exact position for band 240 may allow a greater variety of indicia 244 to be presented on band 240.

Figure 12:
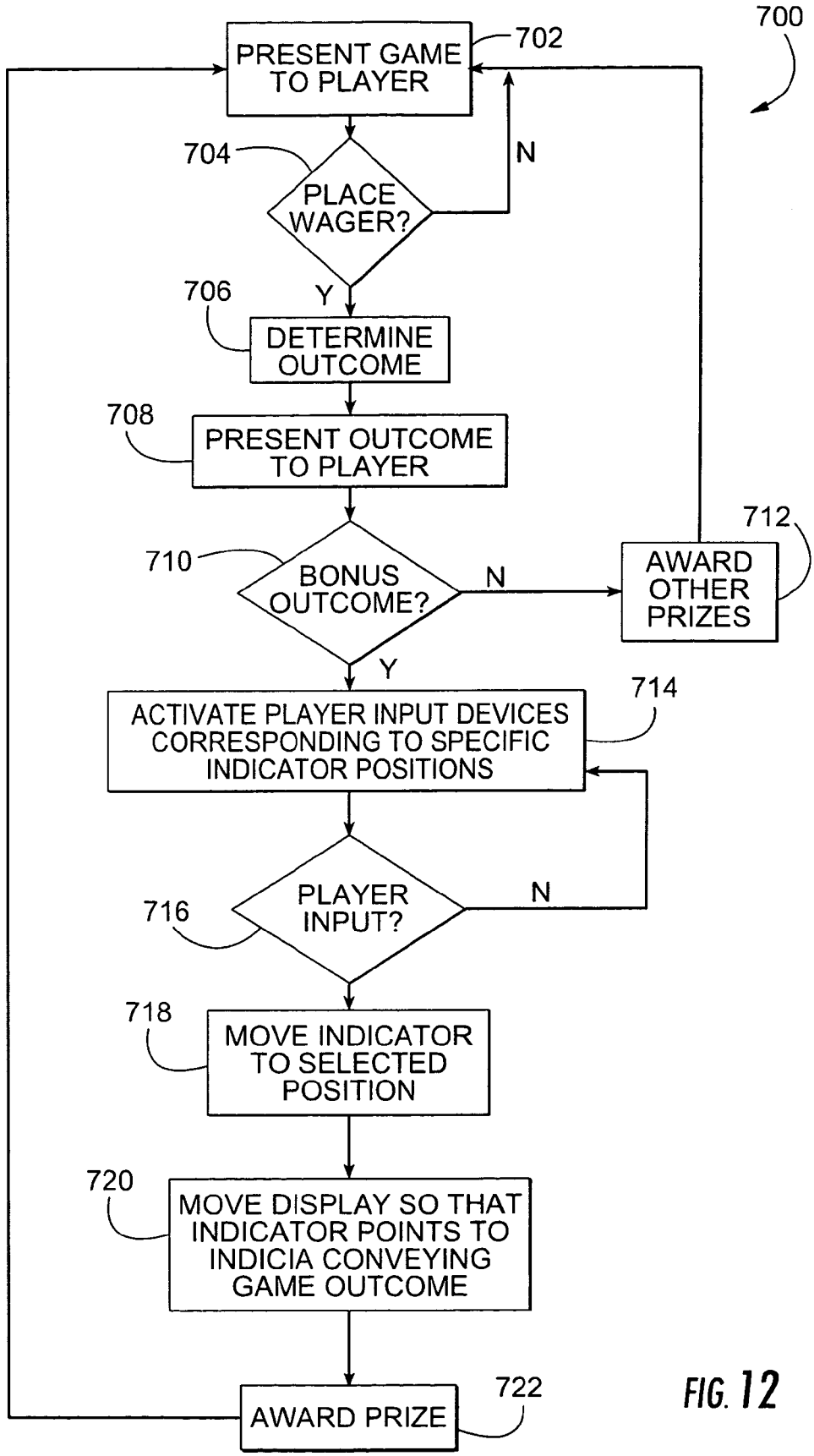
FIG. 12 is substantially a flowchart of a method according to the present invention.

Another gaming method 700 is illustrated in FIG. 12. Steps 702-712 may correspond to steps 502-512 and 602-612 described above. At step 714, one or more player input devices are activated that allow a player to select one or more specific indicator positions. For example, indicia 244 on band 240 could be formed in a plurality of columns. The player input device(s) may allow a player to position indicator 250 by a specific column.

At step 716, method 700 checks to see if the player has provided input. If not, method 700 cycles back to step 714 until input is provided. Once the player has provided input, method 700 proceeds to step 718 and moves indicator 250 to the position selected by the player. At step 720, the display is moved so that indicator 250 points to the indicium conveying the game outcome. Any prize or prizes are awarded in step 722 and then method 700 may return to step 702.

In an alternative embodiment, the player may be allowed to choose a position after the game is begun. In any embodiment, the player's choice of position for indicator 250 might be reflected on band 240, such as illuminating a column of band 240 corresponding to the pre-set position of indicator 250 chosen by the player.

Various additions, subtractions, and permutations of the steps in the above described methods can be made without departing from the scope of the present invention. For example, the player may be allowed to select both the position of indicator 250 and to indicate when band 240 should begin to stop (although not the final position of band 240). The more the player is allowed to interact with gaming device 202, the more control over the outcome of the game the player may feel, which may make the game more enjoyable to the player. Of course, regulatory concerns may dictate that the player's perceived control be largely or completely illusionary.

Methods of operating gaming display 204, including methods 500, 600, and 700, may be set to automatically stop band 240 and/or indicator 250 after a certain time. For example, controller 360 could be programmed to automatically stop indicator 250 and/or band 240 after the passage of a certain amount of time, such as thirty seconds. While it may be beneficial to give the player some interaction with gaming display 204, it may also be desirable to ensure that each game round completes in a timely fashion.

Figure 13:
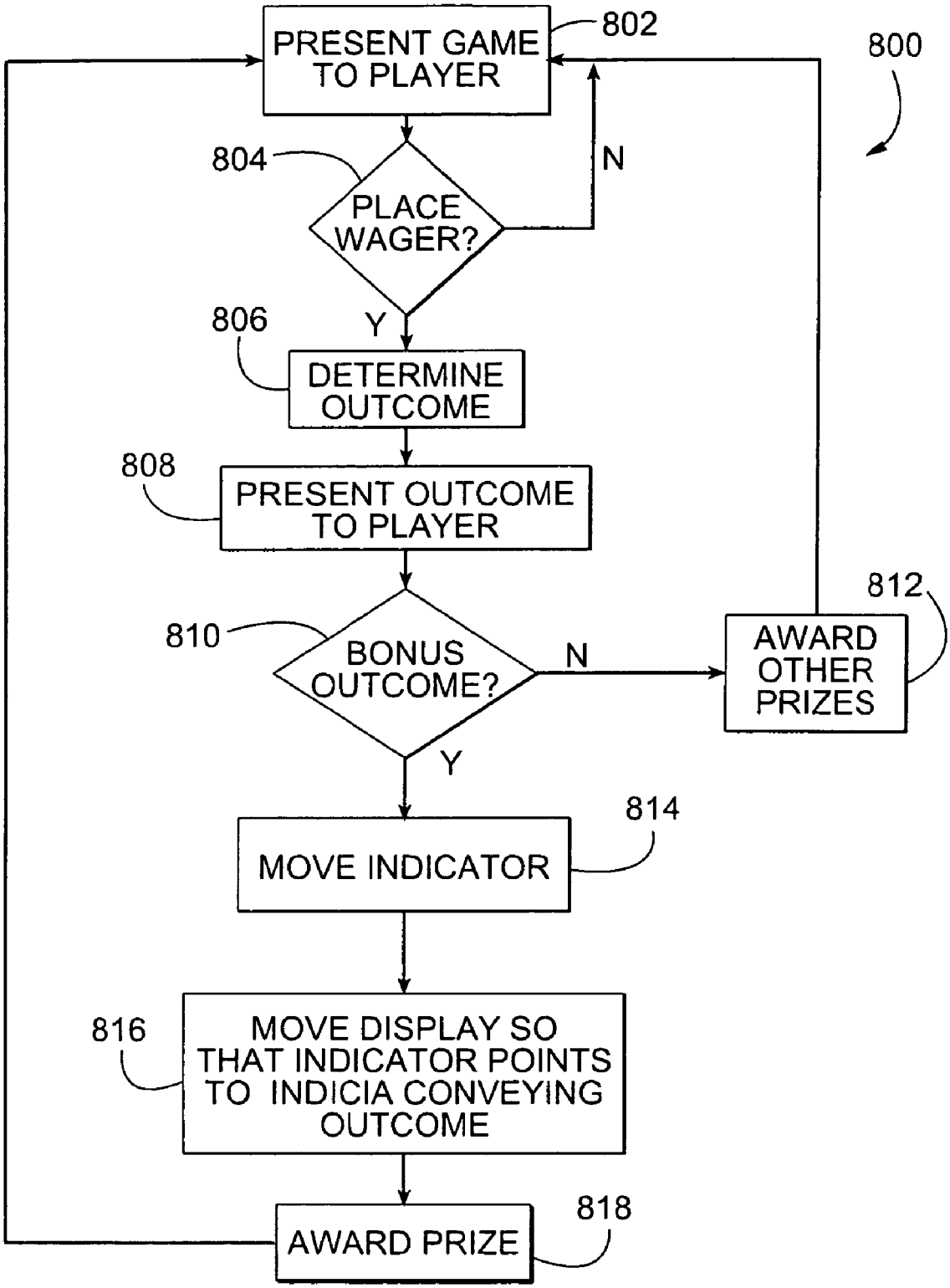
FIG. 13 is substantially a flowchart of a method according to the present invention.

Of course, certain embodiments of the present invention, such as method 800 of FIG. 13, may employ no player input. Steps 802-812 may correspond to steps 502-512 of FIG. 10. At step 814 indicator 250 is moved to a position, which may be randomly selected by controller 360. At step 816 band 240 may be moved so that indicator 250 points to an indicium conveying the game outcome. Any prizes may be awarded at step 818 before method 800 returns to step 802. Of course, steps 814 and 816 may be reversed or presented simultaneously. Also, band 240 could be randomly moved, with indicator 250 being moved to indicate the game outcome.

Figure 14:
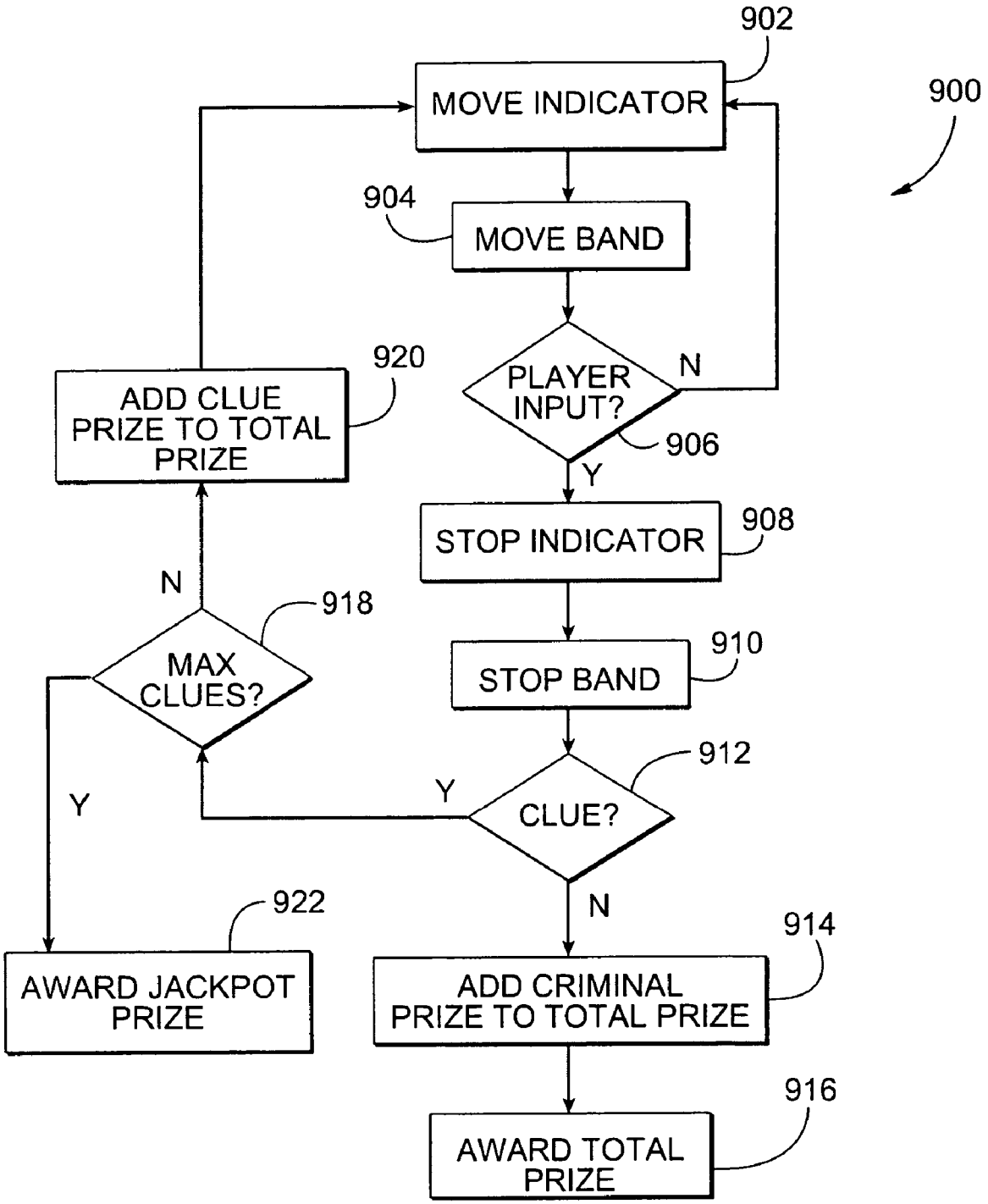
FIG. 14 is substantially a flowchart of a method according to the present invention.

Another method 900 of game play that may be used with embodiments of the present invention, including that of FIG. 5, is shown in FIG. 14. Method 900 may award two types of prizes, illustrated in FIG. 5 as criminal prizes 108 or clue prizes 109. Of course, the prizes could be called or represent various things, have different values than those that will be described, and could be represented by images other than those specifically illustrated. After a game has begun, indicator 250 is moved at step 902. Band 42 is moved at step 904. A player input device is activated and the gaming device waits for player input at decision 906. If no player input is provided, method 900 cycles back to step 902. If input is provided, method 900 proceeds to step 908.

At step 908, indicator 250 is stopped. At step 910, band 42 is stopped so that indicator 250 indicates the indicium conveying the game outcome. Decision 912 checks to see if the indicia is a clue award or a criminal award. If the indicium is a criminal award, method 900 adds a criminal prize to a total prize at step 914. The total prize is awarded to the player at step 916.

If decision 912 determines that the indicium is a clue prize, method 900 proceeds to decision 918. Decision 918 checks to see whether the player has obtained a maximum number of clues, for example, 4. If not, method 900 proceeds to step 920 and adds a clue prize to the total prize and game play continues at step 902.

If decision 918 determines that the player has obtained the maximum number of clues, method 900 awards a jackpot prize at step 922 and game play ends.

Although embodiments of the invention described and depicted in FIGS. 7-14 have been described as a bonus game in conjunction with a primary game, the present invention is not so limited. For example, gaming display 204 (FIG. 7) could be configured as a primary game. A player could make a wager and gaming display 204 could indicate winning and losing outcomes and dispense prizes accordingly. Also, rather than being attached to a primary game, gaming display 204 could be located apart from game 202 (FIG. 7). Gaming display 204 could also be connected to multiple games 202. The present invention is not limited to a particular configuration or configurations.

CONCLUSION

It can thus be realized that certain embodiments of the present invention provide a highly attractive and entertaining device for displaying prizes. Certain embodiments of the present invention further provide a moveable indicator to indicate a bonus prize. Thus, certain embodiments of the present invention can easily catch patrons' attention and invite patrons to play the game. Certain embodiments may further cause players to play longer because the display device enhances the anticipation, stimulation, and excitement experienced by players.

Other embodiments add intermediate steps between the occurrence of the bonus event and the awarding of the bonus prize to add an additional element of anticipation, surprise, and excitement for the players. For example, an indicator may indicate another symbol representing another prize to be added to the player's total prize. An indicator may indicate another symbol representing a multiplier, which may be used to multiply the player's prize.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A gaming device, comprising:

(A) a housing comprising a plurality of walls, the plurality of walls defining a cavity;

(B) at least one moveable indicator associated with the housing and being moveable along a first predetermined path;

(C) a moveable indicator actuator configured to move the moveable indicator in a linear manner along a first axis;

(D) a display device associated with the housing, the display device comprising a band being moveable along a second predetermined path and displaying a plurality of indicia;

(E) a display device actuator configured to move the band in a linear manner along a second axis, wherein the second axis is orthogonal to the first axis;

(F) at least one controller in communication with the display device actuator and the moveable indicator actuator, the controller being configured to determine a game outcome, and to direct movement of the moveable indicator and the band; and (G) a player input device coupled to the housing and in communication with the controller, wherein the player input device allows a player to control the movement of at least one of the moveable indicator and the display device to at least one specific position selected by the player, wherein, after the player has activated the player input device, the controller causes at least one of the display device and the moveable indicator to move such that the moveable indicator indicates at least one of the indicia on the band that corresponds to the game outcome determined by the controller.

2. The gaming device of claim 1, wherein the player's input has no affect on the game outcome.

3. The gaming device of claim 1, wherein the player input device comprises at least one from a group consisting of buttons, joysticks, trackballs, mice, electronic pointers, and touch screens.

4. The gaming device of claim 1, wherein the indicia represent prizes a player may win.

5. The gaming device of claim 4, wherein the prizes are selected from the group consisting of multipliers, jackpot prizes, progressive prizes, currency prizes, game play prizes, services and goods.

6. The gaming device of claim 1, wherein the first axis is substantially vertical.

7. The gaming device of claim 1, wherein the first axis is substantially horizontal.

8. The gaming device of claim 1, wherein the indicia are arranged on the band in an m by n matrix, and m and n are integers.

9. The gaming device of claim 1, wherein the display device actuator comprises:

(a) a chassis;

(b) at least one roller attached to the chassis; and (c) an actuator coupled to the roller; wherein at least a portion of the band is wrapped around the roller, wherein the actuator rotates the roller, thereby causing the band to be rotated and move the indicia.

10. The gaming device of claim 1 further comprising a positioning system for determining at least one position of the moveable indicator.

11. The gaming device of claim 1 further comprising a positioning system for determining at least one position of the band.

12. The gaming device of claim 1, wherein the display device actuator comprises:

(a) at least one idler roller;

(b) at least one drive roller; and (c) a motor in communication with the drive motor, wherein at least a portion of the band is in contact with the idler roller and drive roller and rotates about the idler roller and the drive roller when the drive roller is actuated by the motor.

13. The gaming device of claim 1, the moveable indicator actuator comprising a motor in communication with a worm gear, the moveable indicator being affixed to the worm gear.

14. The gaming device of claim 1 wherein the gaming device is configured as a primary game.

15. The gaming device of claim 1 wherein the gaming device is configured as a bonus game in association with a primary game.

16. The gaming device of claim 14 wherein the primary game is a slot machine.

17. The gaming device of claim 1 wherein the indicia appear on the band in at least one row and at least one column, the indicia are selected from indicia representing a plurality of types of prizes that may be won by the player, and at least one prize of each type appears in each column.

18. The gaming device of claim 1 wherein the indicia appear on the band in at least one row and at least one column, the indicia are selected from indicia representing a plurality of types of prizes that may be won by the player, and at least one prize of each type appears in each row.

19. A gaming device, comprising:

(A) a housing;

(B) a first actuator mounted in the housing;

(C) an indicator coupled to the first actuator, the first actuator being adapted to move the indicator along a first predetermined path;

(D) a second actuator mounted in the housing;

(E) at least one driven roller coupled to the second actuator;

(F) a band at least partially wrapped around the driven roller, the second actuator being adapted to move the band along a second predetermined path;

(G) a plurality of indicia displayed on the band;

(H) at least one controller in communication with the first and second actuators, the controller being adapted to determine a game outcome and to direct movement of the band and the indicator, such that in combination, the band and the indicator indicate at least one of the indicia as the game outcome; and (I) a player input device coupled to the housing and in communication with the controller, wherein the player input device allows a player to direct the movement of either the indicator or the band to at least one specific position selected by the player.

20. The device of claim 19 wherein the first predetermined path comprises a first axis and the second predetermined path comprises a second axis, the first axis being orthogonal to the second axis.

21. The gaming device of claim 19, wherein the specific position of the band is selected by the player and a position for the indicator is selected by the controller.

22. The gaming device of claim 19, wherein the specific position of the indicator is selected by the player and a position for the band is selected by the controller.

23. The gaming device of claim 19, wherein the band is further supported by a plurality of idler rollers.

24. A gaming device, comprising:

(A) a housing;

(B) an indicator associated with the housing and adapted to be moved by an indicator actuator along a first axis;

(C) a band associated with the housing and adapted to be moved by a positioning mechanism along a second axis, wherein the first and second axes are orthogonal;

(D) a plurality of indicia displayed on the band;

(E) a controller in communication with the indicator actuator and the positioning mechanism, the controller being adapted to determine a game outcome and to direct movement of the band and the indicator to indicate the game outcome; and (F) a player input device coupled to the housing and in communication with the controller, wherein the player input device allows a player to direct the movement of either the indicator or the band to at least one specific position selected by the player.

25. The gaming device of claim 24, wherein the specific position of the band is selected by the player and a position for the indicator is selected by the controller.

26. The gaming device of claim 24, wherein the specific position of the indicator is selected by the player and a position for the band is selected by the controller.

27. The gaming device of claim 24, wherein the positioning mechanism comprises a plurality of rollers, the band being supported for movement by the rollers and a band actuator coupled to at least one of the rollers, the band actuator being in communication with the controller.

* * * * *